US009870909B2

(12) United States Patent
Trimpin

(10) Patent No.: US 9,870,909 B2
(45) Date of Patent: Jan. 16, 2018

(54) COMPOSITIONS AND METHODS FOR MASS SPECTOMETRY

(71) Applicant: Sarah Trimpin, Detroit, MI (US)

(72) Inventor: Sarah Trimpin, Detroit, MI (US)

( * ) Notice: Subject to any disclaimer, the term of this patent is extended or adjusted under 35 U.S.C. 154(b) by 0 days.

(21) Appl. No.: 14/739,826

(22) Filed: Jun. 15, 2015

(65) Prior Publication Data

US 2015/0364311 A1 Dec. 17, 2015

Related U.S. Application Data

(60) Provisional application No. 62/012,207, filed on Jun. 13, 2014.

(51) Int. Cl.

| | |
|---|---|
| ***H01J 49/10*** | (2006.01) |
| ***H01J 49/16*** | (2006.01) |
| ***H01J 49/00*** | (2006.01) |

(52) U.S. Cl.
CPC ..... *H01J 49/16* (2013.01); *H01J 49/0095* (2013.01)

(58) Field of Classification Search
USPC ..... 250/281, 282, 283, 288
See application file for complete search history.

(56) References Cited

U.S. PATENT DOCUMENTS

| | | | | |
|---|---|---|---|---|
| 8,853,621 | B2 * | 10/2014 | Trimpin | H01J 49/165 250/282 |
| 9,105,458 | B2 * | 8/2015 | Trimpin | H01J 49/16 |
| 2008/0116366 | A1 * | 5/2008 | Shiea | H01J 49/165 250/282 |
| 2010/0090099 | A1 * | 4/2010 | Chen | H01J 49/0418 250/282 |

* cited by examiner

*Primary Examiner* — Nicole Ippolito

(57) ABSTRACT

The invention provides ionizing matrix compounds. These compounds are useful for mass spectrometry and ion mobility spectrometry as ionizing matrices facilitating transfer of diverse classes of analyte compounds from solid or solution states to gas-phase ions.

20 Claims, 25 Drawing Sheets

(B) Negative Mode (fragile ganglioside)

(1) 1,2-DCB (2) 4-methyl-phthalonitrile (3) 3-NBN

COMPOSITIONS AND METHODS FOR MASS SPECTOMETRY

RELATED APPLICATIONS

This application claims the benefit of the filing date of U.S. Ser. No. 62/012,207, which was filed on Jun. 13, 2014. The content of this application is incorporated by reference herein in its entirety.

STATEMENT AS TO GOVERNMENTALLY SPONSORED RESEARCH

This invention was made with U.S. government support under NSF grant numbers CAREER0955975 and CHE-1411376. The government has certain rights in the invention.

FIELD OF THE INVENTION

The invention relates to mass spectrometry and ion mobility spectrometry and more particularly to ionizing matrices facilitating transfer of analyte compounds from solid or solution states into gas-phase ions when the ionizing matrix is associated with analyte and subjected to conditions in which the ionizing matrix sublimes or evaporates.

BACKGROUND OF THE INVENTION

Mass spectrometry is a powerful analytical method. However, preparing suitable samples can be difficult and time-consuming, and has required high energy inputs to prepare ionized forms of samples to be analyzed.

SUMMARY OF THE INVENTION

The invention is based in part on the discovery that certain matrix compounds produce analyte ions when a mixture of the matrix compound and the analyte is exposed to vacuum conditions without the need to apply high voltage or a laser.

In one aspect, the invention features a method of ionizing an analyte molecule. The method includes providing an ionizing matrix that includes one or more of the compounds shown in FIG. 1, or a derivative of the compounds shown in FIG. 1. The ionizing matrix is then contacted with an analyte to form a sample comprising the analyte and the ionizing matrix. The ionizing matrix in the sample is then sublimed or evaporated to produce gas-phase positive or negative ions of the analyte.

In some embodiments, the ionizing matrix is an aromatic ring compound includes one to three, typically two, functionalities with a negative inductive effect having 1,2- or 1,3-substitution including —$NO_2$, —$SO_2R$, —CN, —COR, —OR, where R is —H, —$CH_3$, —$OCH_3$, and —Cl.

In some embodiments, the derivative of an ionizing matrix compound shown in FIG. 1 has one or more hydrogen atoms replaced with one or more of —R (where R is —$CH_3$, —$C_2H_5$, —$C_2H_3$, $^{-}C_3H_7$,); —OR' and —NHR' (where R' is —H, —$CH_3$, —$C_2H_5$, —$C_2H_3$, —$C_3H_7$); —X, —$CH_2X$, or —$CX_3$ (where X is —F, —Cl, —Br, —I), an aromatic 5- or 6-membered ring, and/or a fused 5- or 6-membered carbon based aromatic structure.

In some embodiments, the subliming or evaporating step is performed at sub-atmospheric pressure, e.g., at a sub-atmospheric pressure that is between 750 mm and $1\times10^{-9}$ mm Hg. In some embodiments, the subliming or evaporating step is performed between 750 mm Hg and $1\times10^{-8}$mm Hg, 750 mm Hg and $1\times10^{-7}$ mm Hg, 750 mm Hg and $1\times10-^{6}$ mm Hg, 750 mm Hg and $1\times10-^{5}$ mm Hg, 750 mm Hg and $1\times10-^{4}$ mm Hg, or between 750 mm Hg and $1\times10^{-3}$ mm Hg. In some embodiments, the subliming or evaporating step is performed at 750 mm Hg.

In some embodiments, the gas phase positive or negative analyte ions are singly charged.

In some embodiments, the gas phase positive or negative analyte ions are multiply charged.

In some embodiments, the gas phase positive or negative ions of the analyte are spontaneously produced.

In some embodiments ionizing matrix sublimes or evaporates at sub-atmospheric pressure.

In some embodiments rate at which the ionizing matrix sublimes or evaporates is temperature dependent.

In some embodiments, the abundance and presence of the gas-phase positive and negative ions of the analyte is dependent on the rate of ionizing matrix sublimation or evaporation.

In some embodiments subliming or evaporating step is performed by exposing the sample to a stream of gas.

In some embodiments sample is placed on a substrate. The substrate can be, e.g., metal, paper, cloth, ribbon, glass, plastic, polymer, sodium dodecyl sulfate gel, agarose gel, paper, thin layer chromatography plate or a woven fiber.

The substrate can be any desired shape, provided it allows for analysis of analyte ions. Suitable shapes include, e.g., pointed, round, hollow, or flat.

In another aspect, the invention provides a method for producing gas-phase analyte ions for analysis by mass spectrometry (MS) or ion mobility spectrometry (IMS). The method includes mixing an ionizing matrix comprising one or more of the compounds of FIG. 1 and an analyte to produce a matrix:analyte sample. The matrix:analyte sample is then exposed to sub-atmospheric pressure to initiate charge separation and production of analyte ions in the matrix:analyte sample.

In some embodiments, mixing is performed by dissolving the ionizing matrix and analyte in a solvent. The solvent can be, e.g., water, methanol, ethanol, isopropanol, propanol, butanol, isobutanol, acetonitrile, tetrahydrofuran, chloroform, dimethylformamide, dimethyl sulfoxide, acetone, ethyl acetate, dioxane, dimethylformamide, methylpyrrolidone, pyridine, hexane, petroleum ether, or a mixture thereof.

In some embodiments, the mixing is performed by grinding the matrix and analyte together to form a powder.

In some embodiments, the matrix:analyte sample is placed on a substrate.

In some embodiments, the matrix:analyte sample is a solution when exposed to sub-atmospheric pressure.

In some embodiments, the matrix:analyte sample is a solid when exposed to sub-atmospheric pressure.

In a further aspect, the invention provides a composition comprising an ionizing matrix compound from FIG. 1 and an analyte.

In some embodiments, the molar ratio of matrix compound to analyte is from 50:1 to $1\times10^{7}$:1. In some embodiments, the molar ratio of a matrix compound to analyte is 50:1, 100:1, 500:1, 1000:1, $1\times10^{4}$:1, $1\times10^{5}$:1, $1\times10^{6}$:1, or $1\times10^{7}$:1.

In some embodiments, the composition is provided sublimated or evaporated.

Among the advantages of the invention is that the methods, termed matrix assisted ionization vacuum (MAIV), produce analyte ions when a matrix:analyte sample is exposed to vacuum conditions, but requires neither high voltage nor a laser. The MAIV method produces multiply charged ions by using a matrix that when exposed to sub-atmospheric pressure conditions spontaneously produces analyte ions of charge states similar to known inlet ionization methods, but without the requirement of a heated channel or a force that allows the matrix:analyte particles to enter the gas phase. The initial ionization event occurs on the surface of the substrate upon which the matrix:analyte sample is placed by exposing the sample to sub-atmospheric pressure available with any mass spectrometer. The MAIV process is spontaneous and occurs until the matrix is consumed, that is, sublimed or evaporated. No external energy (e.g., using heat or a gas) is necessary, so that ionization is initiated by the energy already in the system. This initial ionization event is not dependent on a heated channel, but is affected by temperature and pressure applied to the substrate or channel. Typically, the ionization event occurs upon exposure to sub-atmospheric pressure to speed up the sublimation or evaporation of the ionizing matrix to produce abundant analyte ions.

For example, the ionization event can be initiated by simply placing the sample (i.e., an analyte mixed with an appropriate matrix compound) into the vacuum ion source of a mass spectrometer. Likewise, by placing the sample in sub-atmospheric pressure conditions using an atmospheric pressure ion source inlet, using an appropriate matrix, the ionization event is initiated spontaneously. In either case, heating or cooling the substrate onto which the sample is placed, or the immediate environment surrounding the matrix:analyte sample, using methods known to those practiced in the art, can be useful in increasing the abundance of analyte ions by increasing or decreasing the rate of sublimation or evaporation of the ionizing matrix compound that spontaneously produce analyte ions using the MAIV method. Collisions of the matrix:analyte sample or charged particles thereof with gases and/or surfaces aid in sublimating and evaporating ionizing matrices and, therefore, improve analyte ion abundance.

The MAIV method, as well as other matrix-assisted ionization inlet methods (such as MAII), will be referred to herein as matrix-assisted ionization (MAI) and matrices that produce analyte ions by this method for analysis by MS, ion mobility spectrometry (IMS), MS/MS (and combinations thereof) are referred to as ionizing matrices.

The ionizing matrices described herein increase the sensitivity, selectivity, specificity, or universal nature of MAI. Some ionizing matrices improve the selectivity and specificity to ionize and detect small and large molecular ions by MS and IMS as positively or negatively charged ions. Other ionizing matrices allow for ionization and detection of a broad class of compounds, including detection of multiple analytes simultaneously from complex mixtures directly from surfaces, such as monolayers where MALDI and ESI fail. Some ionizing matrices disclosed herein are suitable solvents for the analyte and are compatible in maintaining the solubility of the analyte solutions. High throughput and automation applications are straightforward and are no longer limited to instruments having a heated inlet tube (as in MAII) or the need for an expensive laser (as in MALDI) or automation device (as in ESI) that have their limitations. Ionizing matrices bring operational freedom as any substrate can be used and without need for desolvation gases, is operational inexpensive, simple, and safe. Cross-contamination is mostly reduced or eliminated with some of these ionizing matrices. Issues of orifice clogging and proper spray conditions, and undesired oxidation using ionization methods such as in ESI are eliminated while producing the similar charge states and ion abundances making new ionizing MAI matrices ideal for direct injection analysis and characterization utilizing MS, IMS-MS and MS/MS including collision induced dissociation (CID), electron transfer dissociation (ETD), and electron capture dissociation (ECD) directly from surfaces. Analytes that are difficult to ionize because of, e.g., low solubility in traditional solvents used with MS can be analyzed with the disclosed ionizing matrices. Some ionizing matrix compounds improve the applicability to field portable and miniaturized mass spectrometers and some to high performance mass spectrometers. Other ionizing matrix compounds improve the applicability to operate from atmospheric pressure and/or directly from vacuum sources using MS and IMS instrumentation. Some matrices increase the charge state of the analyte, and improve the fragmentation (structural characterization) efficiency using MS/MS including CID, ETD, and ECD. Minor instrument modifications and use of proper ionizing matrix compounds enhances the ion abundance of the large and small molecules and reproducibility of the experiment (quantitation). With some ionizing matrices, very little chemical background is detected, in contrast to MALDI, ESI, and some of the known inlet ionization methods. Some ionizing matrices are soft enough to analyze fragile analytes such as ganglioside lipids and phosphorylated peptides, as examples, directly from surfaces such as biological tissue. Some ionizing MAI matrices are useful for tissue analysis and surface imaging of compounds at resolutions related to the area exposed to the ionizing matrix compound or that of the airflow used to dislodge the matrix from a surface and into sub-atmospheric pressure. Examples include those of endogenous and exogenous origin such as drugs, metabolites, pesticides, fungicides, dyestuff, pigments, explosives, lipids, peptides, proteins, chemically or posttranslational modified peptides or proteins, protein complex, receptors, ligands, catalysts, carbohydrates, glycans, antibodies, biomarkers, and other compounds produced by synthesis, such as synthetic polymers, on mass range limited mass spectrometers. These analytes can be in purified form or present in biological/synthetic environments such as urine, blood, skin, tissue sections, biofilms, edible goods, flesh, human, animal, or plant tissue, vegetable or fruit surfaces, drug pills, (adhesive) tapes, synthetic or biological films, bacterial, microbial, artificial bone, archaeological artifacts, painting, or synthetic polymer films, and forensic materials and surfaces such as hair or fingerprints.

Also suitable as sources of analytes are biologic materials such as bodily fluids, including biological samples such as cells, tissues, and bodily fluids or excrement. Some bodily fluids or excrement of interest include, e.g., blood, serum, plasma, saliva, mucous, phlegm, cerebral spinal fluid, pleural fluid, tears, lactal duct fluid, lymph, sputum, cerebrospinal fluid, synovial fluid, urine, amniotic fluid, meconium, feces, and semen. In particular embodiments, a sample may be obtained from a subject, e.g., a human, and it may be processed prior to use in the subject assay. Additional analyte source materials include agricultural and/or environmental agents, including pollutants (such as from aerosol chemistry).

The methods disclosed herein are readily amenable to automation and can be adapted to use by untrained personnel. The production of highly charged ions directly from surfaces in a soft manner and in high abundance allows MS/MS sequencing of, for example, peptides and proteins. The ionizing matrices disclosed herein can be used in analyzing analytes using low-end, including single quadrupole, and field portable and miniaturized mass spectrometers and high-end mass spectrometers. While lasers and voltages can be used, these high energy devices are ultimately not necessary when using the ionizing matrices disclosed herein.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

DETAILED DESCRIPTION

The invention provides methods and compositions useful as ionizing matrix compounds that, when combined with an analyte molecule, are useful, inter alia, for performing mass spectrometry.

The compounds that comprise the ionizing matrices preferably sublime or evaporate from the sample to produce gas-phase positive or negative ions of the analyte compounds. These compounds spontaneously convert molecules to gas-phase ions when exposed to sub-atmospheric pressure, including some compounds that act with remarkable sensitivity (10 fmol of protein insulin). Preferably, the matrices sublime, preferably near room temperature, through exposure to vacuum, and the ability to create charge separation under these conditions. Compounds with and without acidic hydrogen atoms act as matrices and ionize specific compound classes. The matrices work with many different analytes, including peptides, proteins and small molecule drug, lipids and synthetic polymers in the negative and positive ion modes.

Matrix Compounds

Figure 1:
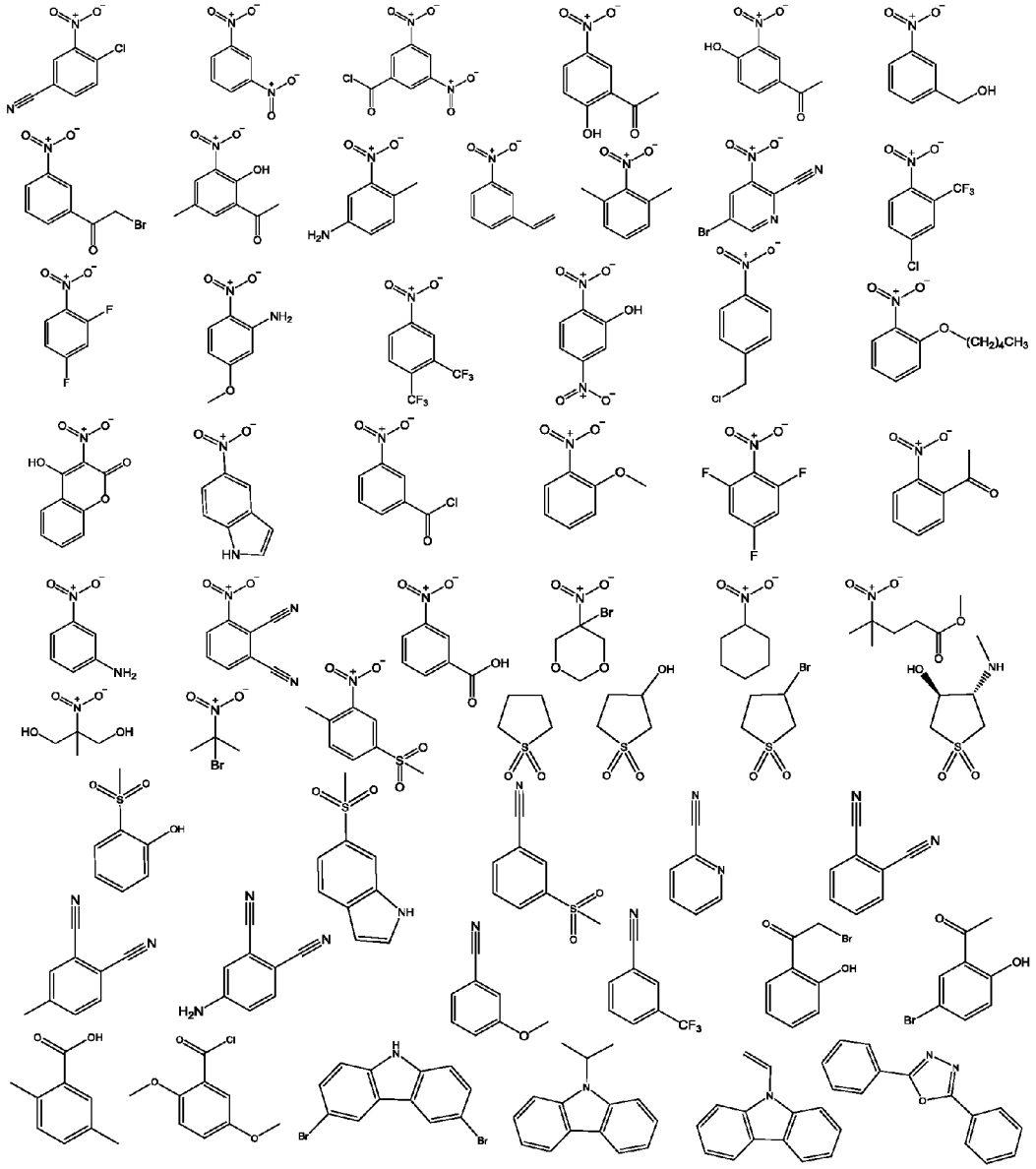
FIG. 1 shows the structures various ionizing matrix compounds.

Suitable matrix compounds are shown in FIG. 1. Ionizing matrices disclosed herein include 4-chloro-3-nitrobenzonitrile, 1,3-dinitrobenzene, 3,5-dinitrobenzoyl chloride, 1-(2-hydroxyl-5-nitrophenyl)ethan-1-one, 1-(4-hydroxyl-3-nitrophenyl)ethan-1-one, (3-nitrophenyl)methanol, 3-nitrobenzoyl chloride, 2-bromo-1-(3-nitrophenyl)ethan-1-one, 1-(2-hydroxyl-5-methyl-3-nitrophenyl)ethan-1-one, 4-methyl-3-nitroaniline, 1-nitro-3-vinylbenzene, 5-bromo-3-nitropicolinonitrile, 1-nitro-2-(pentyloxy)benzene, 1-methoxy-2-nitrobenzene, 2,5-dinitrophenol, 2,4-difluoro-1-nitrobenzene, 4-chloro-1-nitro-2-(trifluoromethyl)benzene, 5-methoxy-2-nitroaniline, 4-nitro-1,2-bis(trifluoromethyl)benzene, 1,3-dimethyl-2-nitrobenzene, 1,3,5-trifluoro-2-nitrobenzene 4-hydroxy-3-nitro-2H-chromen-2-one, 5-nitro-1H-indole, 2-methyl-2-nitropropan-1,3-diol, Methyl 4-methyl-4-nitropentanoate, 2-bromo-2-nitropropane, 5-bromo-5-nitro-1,3-dioxane, nitrocyclohexane, 1-methyl-4-(methylsulfonyl)-2-nitrobenzene, 1-(2-nitrophenyl)ethan-1-one, 3-nitroaniline, 3-nitro-1,2-dicyanobenzene 3-nitrobenzoic acid, 1,2-dicyanobenzene, 4-methyl-1,2-dicyanobenzene, 4-amino-1,2-dicyanobenzene, 3-methoxybenzonitrile, 3-(trifluoromethyl)benzonitrile, 2-bromo-1-(2-hydroxyphenyl)ethan-1-one, 1-(5-bromo-2-hydroxyphenyl)ethan-1-one, 2,5-dimethylbenzoic acid, 2,5-dimethoxybenzoyl chloride, 3,6-dibromo-9H-carbazole, 2,5-diphenyl-1,3,4-oxadiazole, 9-isopropyl-9H-carbazole, 9-vinyl-9H-carbazole, 2-pyridinecarbonitrile, tetrahydrothiophene 1,1-dioxide, (3S,45)-3-hydroxy-4-(methylamino) tetrahydrothiophene 1,1-dioxide, tetrahydrothiophene-3-o1-1,1-dioxide, 3-bromotetrahydrothiophene-1,1-dioxide, 4-[(2-hydroxyethyl)amino]tetrahydrothiophene-3-ol 1,1-dioxide, 2-(methylsulfonyl)phenol, 1-(methylsulfonyl)piperidine-3-carboxylic acid, (phenylsulfonyl)acetonitrile, 3-(methylsulfonyl)benzonitrile, 1-(methylsulfonyl) piperidine-3-carboxylic acid, 4-[(2-hydroxyethyl)amino]tetrahydrothiophene-3-ol 1,1-dioxide, (phenylsulfonyl)acetonitrile, and 1-(chloromethyl)-4-nitrobenzene. These compounds produce ions from associated analyte molecules when exposed to sub-atmospheric pressure and the matrix or surroundings are heated to less than 50° C. Analyte ions can be singly or multiply charged, similar to preparing analytes for electrospray ionization (ESI) mass spectrometry. Thus, low molecular weight compounds typically produce singly charged ions, while higher molecular weight compounds primarily produce multiply charged ions, similar to ESI. The matrix compounds therefore extend the mass range of API mass spectrometers, allowing for low and high performance mass and ion mobility measurements and characterization using MS/MS methods such as CID, ETD, and ECD. The matrices shown in FIG. 1 are mixed with an analyte in a solvent system to form a solution. The solvent can be, for example, water, methanol, ethanol, isopropanol, propanol, butanol, isobutanol, acetonitrile, tetrahydrofuran, chloroform, dimethylformamide, dimethyl sulfoxide, acetone, ethyl acetate, dioxane, dimethylformamide, methylpyrrolidone, pyridine, hexane, petroleum ether among others, or a mixture thereof. Typically, the solvent is evaporated to produce matrix:analyte crystals before introduction to the sub-atmospheric pressure region of the mass spectrometer or ion mobility spectrometer. However, introducing the matrix:analyte sample in solution to sub-atmospheric pressure also produces analyte ions, presumably because the solvent evaporates, thereby leaving the matrix:analyte crystals from which ionization is initiated.

Alternatively, the matrix and analyte may be ground together using methods of solvent-free MALDI and the powder introduced to sub-atmospheric pressure. The ionizing matrix compound is typically present in high excess relative to the analyte.

While the ionizing matrices shown in FIG. 1 all produce analyte ions when introduced to sub-atmospheric pressure without use of a laser, high voltage, particle or ion bombardment, and with the matrix or surrounding heated to less than 50° C., application of higher temperatures to the matrix or surroundings, for some of the matrices, increases the analyte ion abundance and shortens the time over which ions are observed. Applying heat to the matrix sample increases the rate of sublimation/evaporation of the matrix and potentially increases the rate of gas-phase charged particle formation (charge separation). Once gas-phase charged matrix particles are produced, the matrix must be removed to produce the observed analyte ions. Increasing the heat of the inlet, or providing an obstruction for collisions, or a radio frequency field, or other means known to those practiced in the art will result in loss of matrix from the gas-phase charged particles and increase the abundance of observed analyte ions. All of the ionizing matrices shown in FIGS. 1 sublime when exposed to sub-atmospheric pressure when heated to <50° C. and typically at ambient temperature. Thus, the ionizing matrices will sublime when placed in the vacuum so that matrix contamination of elements within the mass spectrometer or ion mobility spectrometer is eliminated. The ionizing matrices shown in FIG. 1 also have the attribute of producing the maximum analyte ion abundance when placed under sub-atmospheric pressure when the substrate onto which the matrix is applied or the inlet temperature is less than 150° C. and typically <70° C. Many of the ionizing MAI matrices in FIG. 1 produce high quality mass spectra with the inlet and substrate below a hazardous temperature and with little or no voltage applied to the inlet. Thus, these ionizing matrices allow safe operation of the mass spectrometer without need of an ionizing housing such as with ESI, atmospheric pressure chemical ionization (APCI), ambient ionization methods, and atmospheric pressure MALDI, and without need of nebulizing or desolvation gases as in ESI and APCI.

Some ionizing matrices preferentially ionize basic compounds, while others are more universal ionizing acidic, basic, and neutral compounds. Some ionizing MAI matrices in FIG. 1 provide enhanced negative ion results, while others provide enhanced positive ion results. Thus, some of these ionizing matrices provide more inclusive ionization of analytes, which is especially advantageous when analyzing unknown compounds. Other ionizing matrices provide more selective ionization of analytes which is advantageous when determining whether a known compound (e.g., a protein biomarker) is present.

Additional compounds having structures similar to those depicted in FIG. 1 are likely suitable MAI matrices. For example structurally similar compound or derivatives of the ionizing matrices depicted in FIG. 1 can have one or more hydrogen atoms or other groups in the compound replaced with one or more of —R (where R is —$CH_3$, —$C_2H_5$, —$C_2H_3$, —OR' and —NHR' (where R' is —H, —$CH_3$, —$C_2H_5$, —$C_2H_3$, —$C_3H_7$); —X, —$CH_2X$, or —$CX_3$ (where X is —F, —Cl, —Br, —I), an aromatic 5- or 6-membered ring, and/or fused 5- or 6-membered carbon based aromatic structure so long as the compound thus formed sublimes when placed under sub-ambient temperature at <50° C.

The criteria for all ionizing matrices is that they sublime or evaporate at sub-atmospheric pressure and at a temperature of less than less than 50° C., less than 40° C. or less than 30° C. In addition, the charge separation mechanism requires the ionizing matrix have a dipole. Thus, structures similar to those in FIG. 1 exhibiting a dipole and having the property of sublimation below 50° C. when placed under sub-atmospheric pressure can be useful ionizing matrices.

Preparing Matrix Compound-Analyte Samples

Matrix compounds are combined with a desired analyte selected to ionize spontaneously. The potential importance of a sensitive spontaneous ionization method that only requires a matrix and the vacuum inherent with any mass spectrometer led us to retest all matrix compounds found to produce ions at low inlet tube temperature on the LTQ Velos or intermediate pressure vacuum source of the SYNAPT G2. Additionally, other compounds were tested that were known to sublime in vacuum or triboluminesce. However, with this spontaneous ionization approach, only a single matrix:analyte sample can be tested at a time using a vacuum source. Some compounds entirely sublimed in the two minutes between being exposed to vacuum and reaching the ionization region. Others sublimed slowly without producing any analyte ions. Because of the disadvantages of using the intermediate pressure vacuum source designed for MALDI operation for compound screening, we developed two new approaches to more rapidly test compounds as potential matrix candidates using the atmospheric pressure Z-Spray inlet aperture of the SYNAPT G2 mass spectrometer.

In one method, a device with a larger inlet aperture was used that replaced the original Z-Spray source cone, and is capable of holding a glass microscope slide by the pressure differential between the vacuum of the mass spectrometer and atmospheric pressure. To prevent the mass spectrometer from venting with this arrangement, the isolation valve may be in the open position only when a glass plate sealed the aperture. Samples can be changed in seconds by opening and closing the isolation valve in conjunction with changing the glass slide. Using this device with the ion source at 80° C., certain of the compounds screened that are solids at room temperature (e.g., 3-nitrobenzoyl chloride, 2,5-dinitrophenol, 2-methyl-2-nitro-1,3-propanediol, 4-hydroxy-3-nitrocoumarin) were found to produce multiply charged ions from a mixture of peptides and proteins.

A second method was found to be efficient for screening purposes and also for rapidly acquiring data on samples brought to our laboratory for analysis. In this approach, one microliter of the matrix solution containing the analyte is drawn into a pipet tip and briefly allowed to crystallize followed by the tip being exposed to the vacuum at the unmodified skimmer cone of the commercial Z-Spray source of the SYNAPT G2. Airflow in the region where the pipet tip is brought near the entrance of the Z-Spray source draws matrix:analyte crystals into the vacuum. Airflow aids the ionization process, possibly by assisting sublimation of the matrix either in the initial charge separation process lifting the matrix:analyte from the respective substrate or with desolvation of the subsequently produced charged particles.

The time during which the matrix sublimes relates to how long ions are observed and can be influenced by temperature. With the atmospheric pressure Z-Spray source, heat from the source block can be applied to speed the rate of sublimation and momentarily increase the analyte ion abundance. For example, at a source block temperature of 30° C., matrix compounds phthalonitrile and 4-methyl-phthalonitrile sublime in under 4 min, while methyl-2-methyl-3-nitrobenzoate and 4-aminophthalonitrile sublime over a time range of 8 to 25 minutes. A common property shared by all ionizing matrices is an increased rate of sublimation at source block temperatures above 30° C., so that at temperature exceeding 50° C. the analyte ion signal may last only a few seconds. On the intermediate pressure vacuum source of this mass spectrometer where no heating mechanism is available, sublimation requires minutes, and in some cases hours, likely influenced by less airflow, increased vacuum and/or operation from room temperature.

While the performance of each matrix varies greatly, ionizing matrix compounds have been discovered that create gas phase ions when exposed to sub-atmospheric pressure at moderate or even cold conditions from volatile and non-volatile analyte molecules.

Typically, the ionizing matrix and analyte are dissolved in solvents such as acetonitrile/water mixtures from 0-100% water and mixed to make a sample solution. Drying the sample solution creates matrix:analyte crystals that when exposed to conditions that cause sublimation or evaporation, such as sub-atmospheric pressure, initiate the charge separation event that leads to gas-phase analyte ions. The sample solution can be directly exposed to sub-atmospheric conditions without the drying step as drying will occur spontaneously under these conditions. Alternatively, the ionizing matrix and analyte can in some cases be ground together to form a fine powder which when exposed to sub-atmospheric pressure produces gas-phase analyte ions. In each instance, the concentration of the matrix used is greater than the analyte (typically, at least 50:1 to as much as 5,000,000:1 matrix:analyte molar ratio).

In MAI, the traditional ion source as in ESI and MALDI which supplies the ionization energy can be eliminated using only an inlet to the mass spectrometer which can be simply a pin-hole leak, a (mini) vacuum chamber, or gentle airflow. Ionization is typically initiated through exposure of the matrix:analyte sample to sub-atmospheric pressure conditions in which the sample is in fluid contact with the sub-ambient pressure of the mass or ion mobility analyzer. When the sample is exposed to sub-atmospheric pressure, ionization commences spontaneously and is continuous until the ionizing matrix in the sample is depleted or, for multiple samples, the sample substrate is moved to the next the sample or removed from the sub-atmospheric pressure region. Ionization can be prolonged by, for example, cooling the substrate or its immediate environment, or intensified, for a shorter duration by heating the substrate, inlet, or a gas impinging the sample.

The ionizing matrices disclosed herein, when placed in sub-atmospheric pressure, are believed to spontaneously splinter charged matrix particles from the surface. It is therefore postulated that this splintering process initiates the ionization event. According to the above postulate, the splintered particles have excess positive or negative charge. One means of producing a charge when a surface cracks (splinters) is through the mechanism that produces triboluminescence or light when a crystal is crushed. The light is caused by a discharge between cracked surfaces that have opposite charges. Terminology for this phenomenon include triboluminescence, fractoiluminescence, triboelectrification, ferroelectricity as examples of the general term of "electrification". The ionizing matrices are organic and inorganic molecules that undergo electrification and are sufficiently volatile that the matrix is removed from the charged matrix: analyte particles by sublimation or evaporation to release the gas-phase analyte ions. Ionizing matrices including those disclosed here are typically asymmetrically substituted, whereas MALDI matrices are frequently 1,4-substituted (e.g., alpha-cyano-4-hydroxycinnamic acid (CHCA), sinapinic acid).

In MAI, it is envisioned that the charged particles splintered from the surface may undergo further splintering producing smaller charged particles. The splintered particles have either excess positive or excess negative charge. Other ionization processes are also possible including analyte ionization directly from the matrix surface. In any case, the ionization process depends on the sublimation/evaporation and electrification characteristics of the ionizing matrix and therefore the pressure, temperature, and gas-flow conditions which easily allow targeted manipulation of the duration and intensity of the ionization events.

In some embodiments, all of the ionizing matrices evaporate or sublime under sub-atmospheric pressure at temperatures below 50° C. and ideally at ambient temperature so that the matrices are removed from the mass spectrometer or ion mobility spectrometer.

With an ionizing matrix, the sample can be exposed or inserted to sub-atmospheric pressure of a mass spectrometer or ion mobility spectrometer, and analyte ions (of positive and negative charge, hereafter referred to positive and negative ions) are produced without the need of a laser or a high voltage. Low voltages are used to guide the ions to and through the analyzer and to the detector enabling the use of common mass and ion mobility spectrometers.

The substrate holding the matrix:analyte sample can be mechanically introduced to a vacuum source similar to solid probe introduction in electron ionization (EI) and chemical ionization (CI) methods or using a sample plate with introduction as in MALDI, or inserted through a septum such as those used in injectors in gas chromatography with analyte ionization commencing when the sample experiences the sub-atmospheric conditions without the use of a laser, impacting ions or particles, high voltages, or the need of a heated channel. Spontaneous ionization can be controlled by controlling the temperature of the substrate surface, the use of matrix combinations, or limiting the exposure to vacuum conditions by, for example, placing the sample within a capillary that allows only a small surface area of the sample to experience the sub-atmospheric pressure. Alternatively, a continuous matrix:analyte can be supplied using a syringe pump assembly to provide continuous ionization over a prolonged time period. This may be of special interest in MS/MS or LC/MS and MS/MS applications.

Commercially available inlets of atmospheric pressure ion sources (e.g., skimmer or inlet tube) can be exposed to the operator without need of the ion source enclosure because the inlet for the new ionizing MAI matrices can be near ambient temperature and without application of more than a few volts for focusing the ion beam. Ionization preferably occurs inside of the mass spectrometer inlet so that dangerous fumes and gases are eliminated further improving operator safety. Further, the only requirement for ionization being the vacuum inherent in the operation of the analyzer, the energy necessary to operate the instrument is reduced. Thus, the ionizing matrices described herein are useful for field portable and potentially miniaturized instruments with low pumping capacity. Suitable analytes are, e.g., fragile compounds, including protein complexes, post-translational protein modifications (e.g., phosphorylated or sulfated proteins), fragile chemical modifications, such as catalysts and magnetic resonance imaging contrast agents, gangliosides containing fragile sialic acid modifications that tend to fragment using high energy ionization sources (e.g. MALDI), or compounds that are sensitive to certain pH values. The chemical background associated with ESI and especially MALDI limit these techniques for some analyses. However, chemical background levels are low with many of the ionizing matrices. Further, the simplicity and robustness of some of the ionizing matrices disclosed herein make MAI potentially useful for clinical analyses and explosive/warfare detection. The ionizing matrices can be useful in automating mass spectrometric analysis of analytes using disposable sample introduction devices such as pipet tips, paper, and glass, and metal plates. Some of the ionizing matrices preferentially ionize by metal cation attachment making it possible to characterize synthetic polymers using MS, IMS, and MS/MS. The disclosed system and method comprises placing the ionizing matrices with incorporated analyte in fluid communication with a region of sub-atmospheric pressure, typically generated by the pumping system of an ion mobility or mass spectrometer. This MAI method using the disclosed ionizing matrices is applicable to vacuum ion sources such as those used with MALDI or with EI or CI, but does not require a laser as in MALDI, added heat as in EI, or CI, to vaporize volatile compounds, or a high voltage as used in ESI and in MALDI.

The ionizing matrices disclosed herein are capable of producing abundant singly or multiply charged ions for use in MS and IMS-MS, and MS/MS using fragmentation methods including CID, ETD, and ECD as examples. The systems and methods using these matrices can be modified for certain advantages by using smaller or multiplexed surfaces/containers, and high throughput analyses using matrices with low thermal requirements for analyte ion formation, or with the addition of heat or cooling supplied to the sample surface or substrate, or to the inlet region, or by addition of a gas in close proximity to the sample or aimed at the sample to provide enhanced ion abundance to use with mass spectrometers, especially having low pumping requirements or improved spatial resolution.

This method allows for analysis of compounds of varying volatility, as well as compounds of widely differing molecular weights by simply introducing the analyte in one of the ionizing matrix compounds, or a combination of matrices, or a combination of matrix and additive (simple examples include lithium salts, ammonium salts, acids or bases) combinations, here simply referred to as matrix, into a vacuum region of a mass spectrometer. For example, bovine insulin (BI), molecular weight 5.73 kDa, produces abundant multiply charged molecular ions using the matrix 1,2-dicyanobenzene (or phthalonitrile, 1,2-DCB) with the sample (matrix:analyte) placed in solution in a pipet dried or alternatively the matrix and analyte can be in solution (the drying step prior to the ionization step is not necessary as it can occur within the vacuum system). Using mass spectrometers equipped with CID, ETD, or ECD technology, and variations thereof, intentional MS/MS fragment ions can be generated, especially from highly charged ions. IMS and IMS-MS are improved because complex samples can be efficiently ionized and analyzed using the disclosed ionizing matrices. These matrices are especially useful for analyzing samples that are not easily amenable to traditional ionization methods used in MS because either the sample contains many salts, contaminants or is insoluble in traditional solvents.

Mass spectra can be obtained using atmospheric pressure ionization (API) inlets typically used with ESI by placing the matrix:analyte sample near, at, or in the aperture of the atmospheric pressure to vacuum inlet. For example, the ionizing matrix solution and then analyte solution, or vice versa, or a combined mixture can be placed onto filter paper and placing the sample on the filter paper substrate in close proximity to, e.g., apposed to ,against, or inside the inlet aperture, to produce gas phase ions of the analyte. Air flow through the filter paper enhances the ion abundance with certain ionizing MAI matrices. Air flow can be achieved, for example, by using compressed air at or above atmospheric pressure, incomplete seals or a guided air leak into the vacuum. The paper creates sufficient vacuum for ionization to occur even though some air is able to flow through the gas permeable paper. The disclosed ionizing matrices provided the first example of converting nonvolatile compounds to gas phase ions by simply exposing matrix:analyte, the sample, to sub-atmospheric pressure. Phthalonitrile, 4-methyl phthalonitrile, and 2-methyl-2-nitro-1,3-propanediol are examples of ionizing matrices that produce ions with vacuum assistance at ambient temperature, in addition to those matrix compounds that function as ionizing matrices when directly placed in a vacuum. Other ionizing matrices are more effective at lower temperatures, e.g., when cooled or frozen prior to and/or during ionization. These compounds may have low melting points (typically below 70° C.) or are liquids at room temperature.

Besides the ease of ionization, low cost, and safety of MAI and its application to a wide array of instruments and approaches, the method also provides advantages for ionization where a low energy ionization process is preferred. For example, the ionizing matrices disclosed herein can be for the analysis of complexes, such as protein-drug, or protein-protein complexes which are unstable to any energy source or in studying ion structures (cross sections) by ion mobility where energy supplied in the ionization process can affect the ion structure. Structures are "frozen" out by drying of the ionizing matrix and released into the gas phase of the mass or ion mobility spectrometer. The ionizing matrices disclosed herein may be used to analyze surfaces, as in biological tissue, to characterize compounds on the surfaces without application of energy, as is the case with, for example, MALDI analysis. The ionizing matrices disclosed herein can also be used in the analysis of one or more analytes on thin layer chromatography (TLC) plates, paper chromatography, and 1-D and 2-D gel electrophoresis or from liquid chromatography, capillary electrophoresis, or size exclusion chromatography in an online or offline approach (e.g., collection onto flat surfaces or into well-plates for subsequent rapid ionization of individual collections), or using a syringe pump. For example, blood spots can be directly analyzed from paper or any other amenable substrate using the ionizing matrices disclosed herein. The substrate can be pre-coated with matrix, and only the analyte need be deposited to the substrate. The analyte can be deposited on the substrate and the matrix added subsequently whenever ready for analysis. Such a simple and robust ionization processes, requiring only application of an ionizing matrix solution and exposure to sub-atmospheric pressure and capable of ionization of volatile (e.g., drugs)

and nonvolatile compounds (e.g., large proteins, fragile complexes or modifications such as phosphorylation sites of peptides/proteins or sialic acids of ganglioside lipids in positive or negative mode, as examples), is expected to have numerous applications including in clinical analyses (e.g., high speed sample introduction of biological matrixes such as urine and whole blood), proteomics applications (using e.g., the more traditional bottom up approaches based on 1-D and 2-D gels or LC including gel-permeation chromatography, capillary electrophoresis or in top down proteomics), field portable instruments, and forensic analyses.

Ionization that occurs in the sub-atmospheric pressure can be associated with the ionization region of commercial mass spectrometers such as the commercial or modified inlets (inlet tubes, skimmers, etc.) of an API source (ESI, APCI, inlet ionization) or a vacuum ionization source (MALDI, LSIV) of a mass spectrometer or ion mobility spectrometer facilitated by an appropriate small molecule matrix assisting in analyte ionization. The matrix:analyte sample can be exposed to sub-atmospheric pressure from atmospheric pressure or mechanically placed directly into the vacuum of the mass spectrometer. Bare analyte ions and charged matrix:analyte particles can be carried to the mass or ion mobility analyzer by the flow of gas or by creating electric fields. Providing means for enhanced evaporation or sublimation of matrix from the gas phase charged particles or droplets produced in the initial spontaneous ionization event can enhance the abundances of gas-phase analyte ions detected. Means of providing energy to enhance this desolvation process include heat by such means as radiative as in microwave, IR, visible, or UV radiation, radio frequency fields, gas flow and collisions with gaseous molecules or solid surfaces, and other methods known to those practiced in the art. None of the ionizing matrices disclosed herein require any form of energy to propel the matrix:analyte association into the gas phase, or in the ionization event.

Multiply and singly charged ions of volatile and nonvolatile analyte compounds are formed without the need for application of voltages, a laser, or high velocity particles for analyte ionization. The commercial mass spectrometer separates and detects the formed ions according to the mass-to-charge (m/z) ratio and ion mobility analyzers by the charge, size, and shape of the ion. Sub-atmospheric pressure is defined as between 750 mmHg and $1\times10^{-9}$ mmHg. However, the ionizing matrices may be heated with a gas stream, such as as stream of air or nitrogen, near to an inlet of the MS or IMS instrument to initiate ionization.

The ionization matrices are mixed with the analyte in a solvent and the sample applied to a substrate for placement at or near the ionization region (e.g., inlet aperture of the atmospheric pressure or the ion extraction element of the intermediate pressure or low pressure mass spectrometer or ion mobility spectrometer) so long as the sample is exposed to sub-atmospheric pressure. Some of the solvents (including water and methanol) do not require the addition of an ionizing matrix as these solvents are ionizing matrices themselves in accordance with their triboluminescence characteristics when in solid form. Depending on the ionizing matrix, heat may advantageously be applied to the matrix, the substrate onto which the ionizing matrix is applied. The solvents (e.g., acetonitrile, water, or methanol) can be the same or different for the matrix and analyte, and the analyte can be in the same solution as the matrix or separate solutions that are mixed before analysis. Acids and bases can be added for certain analytes and salt additives can be used for certain compounds (i.e., synthetic polymers). Buffers can be used when analyzing, for example, protein-small ligand and protein-protein complexes. Conditions not amenable to ESI are applicable because no capillary clogging can occur nor are there sprayable conditions to be considered with the novel ionizing MAI matrices. Thus, it is possible to use ionizing matrices with analytes that are derived from crude extracts, mixtures of reactants, or samples containing salts or buffers without prior purification or extensive sample preparation prior to mass spectral analysis. Sample cleanup and user expertise is not necessary for using the ionizing matrices disclosed herein. Some of the ionizing MAI matrices are sufficiently sensitivity and soft to analyze monolayer catalysts for which ESI is only indirectly applicable and MALDI is too harsh. Ammonium and other salts can be added to the matrix or analyte to reduce chemical background or enhance analyte ion abundance. Low, neutral, or high pH can be used with the disclosed ionizing matrices. The sample solution can be dried or in solution when introduced against or within a region near the inlet influenced by the low pressure of the instrument. If the sample is introduced in solution, lower pressure conditions and heat aids solvent vaporization and subsequently ionization. Negative and positive mode measurements can be performed according to the preferred analyte structure such that acidic molecules (e.g., fatty acids, gangliosides, cardiolipins, phosphorylated peptides) preferentially ionize in the negative mode and basic compounds (e.g., proteins, peptides, drugs) preferentially ionize in the positive mode by proton attachment and synthetic polymers by metal cation attachment and depending on the structure proton or metal cation attachment of catalysts, cancer vaccine carbohydrate conjugates, and magnetic resonance imaging contrast agents. Using the ionizing matrices disclosed herein, the mass range is further extended by enhanced multiple charging of the analyte for use of low and high performance mass spectrometers with their full enhanced capabilities including, but not limited to, accurate mass measurements, high mass resolution measurements, improved ion mobility separation, high efficiency detection using image charge detection, high efficiency fragmentation of multiply charged ions using CID, and high performance fragmentation using ECD and ETD known to those of skilled in the art. Due to the high ion abundance and charge states produced by some of the new ionizing matrices, the MS performance characteristics are greatly improved. Small molecules such as drugs, prescription and illicit, and their metabolites, lipids, carbohydrates, triglycerides, proteins and protein-complexes are some analyte examples. More specifically, compounds derived from tissue (e.g., animal, human, or plant) are ionized and analyzed simultaneously such as clozapine and lipids and their metabolites. Because hot/cold spot issues, limiting MALDI at atmospheric pressure and vacuum, are eliminated and ion production is continuous as in ESI, irreproducibility and quantitation issues are minimized with the ionizing matrices disclosed herein.

The substrate onto which the matrix is placed may be a variety of materials that do not provide chemical contaminants that unduly add to the background or suppress ionization. The substrate may be impervious to surrounding atmosphere, typically air or nitrogen gas, or permeable allowing some flow of gas through the substrate. Typically, with an atmospheric pressure ion source, gas flow aids transfer of ions to the mass analyzer, and thus, some airflow enhances ionization using inlets of API sources. The gas flow can be achieved by use of permeable substrates, imperfect vacuum seals, or by controlled gas leaks. While the vacuum source can make use of the same principle, vacuum ionization sources can also use voltage to direct ions from the substrate towards the analyzer as known by practitioners. Materials for the substrate such as, but not limited to, paper (especially filter paper), metal (plate, foil, or mesh), glass plates or tubes (filled/deposited inside or outside with the sample), synthetic or natural polymers (e.g., well plates, pipet tips, tooth picks, pins, needles, threats), and fibers can be used to introduce the sample to the sub-atmospheric pressure region where ionization commences. Substrates can be materials used for 1- and 2-dimensional separations (paper chromatography, TLC plates, gels (e.g., SDS-PAGE, agarose).

The ionizing matrix is deposited manually or sprayed on the surface or deposited directly into the material containing the analyte, and the surface is then affixed to or exposed to sub-atmospheric pressure for ionization of individual spots, regions or the entire 2-D surface of flat or curved objects. Sampling the surface in a systematic fashion, similar to imaging by MS, provides the location of the respective analyte such as a drug from a dollar bill or a protein from a 1-D gel but without the necessity of a laser while providing spatial (e.g., matrix deposition guided by a microscope) and temporal analyses (e.g., rapid reaction monitoring including those of protein folding). The analyte can be on or in a material (e.g., pesticide on a fruit) or part of a material (e.g., active ingredient of a drug directly from a pill (tablet) surface, illicit drugs in hair, mouse brain tissue, living skin or flesh, or plant tissue).

With the ionizing matrices disclosed herein, a variety of methods can be usedused to achieve rapid and automated analyses. For example, a sample applied in a 2-D grid pattern can also be automatically moved, regardless of the direction and at a desired speed, across the inlet entrance to effect ionization of an analyte exposed to an ionizing matrix. In some arrangements, the substrate surface does not have to be in fluid contact with the inlet aperture but sufficiently close to experience the sub-atmospheric pressure in close proximity to the inlet aperture. The gas flowing into the inlet and across the sample, whether by passing through a permeable substrate or by way of a poor vacuum seal of the substrate with the inlet aperture, can be warmed to aid the initial ionization process. Pipet tips (single, or arranged in a line or array) dried, semi-dry, or wet with the sample can be brought near or in fluid contact with the inlet aperture and a robot can be used to automate this process. Again the ionization process is initiated when the sample experiences sub-atmospheric pressure. Similarly, tissue sections and gel sample surfaces can be specifically analyzed using this principle by using a xyz-stage to bring a specific sample area to close proximity or by penetrating the surface layer. Gas flow can be used to further enhance the analyte ion abundance and, if well-defined, provides sufficient spatial resolution and can be sampled in continuous or discontinuous mode. Well plates, commonly used for high throughput studies, will also suffice as a substrate. The sample loaded into wells can be allowed to dry, and a robot or x,y,(z)-stage can move the various wells individually to the ionization region. The mass spectrometer or ion mobility spectrometer's inlet can be extended with a tube (or nozzle) rather than the necessity of bringing the well plate or other surfaces that may be flat to the inlet of the instrument of a modified API inlet. Either the substrate can be moved or the inlet tube extension moved so as to have the sample in intimate contact with the inlet or inlet extension. A specific example is that the ionizing matrices can be used with robotics such as the Advion Nanomate to automatically acquire mass spectra from microtiter plates without need of voltage or special ESI emitter plates. The matrix can be pre-applied to a surface such as a ribbon, paper, or well plate in order to simplify the process of loading the sample. With a preloaded matrix, only a solution of analyte needs to be applied.

Ion mobility and mass spectrometers with and without coupling the two technologies can be used with the ionizing matrices for applications such as medical diagnostics, homeland security, field portable and hand-held device applications. The MAI method is applicable to peptides or proteins, intact or enzymatically digested, non-modified or modified such a posttranslational including phosphorylation, acetylation, glycosylation, oxidation, methylation indicative of disease states, as well as for lipids including fragile gangliosides and cardiolipins also indicative of disease states. Ionizable analytes for biomedical and clinical applications include biological tissue, animal tissue, human tissue, plant tissue, biological material including extracts such as mitochondria, cell culture, bacteria, skin, urine, or blood, drugs, drug metabolites, endogenous metabolites, as well as synthetic compounds including synthetic polymers, paintings including dye stuff, archaeological artifacts, oligonucleotides, sugars and carbohydrates, forensics materials such as hair and fingerprints, explosives, warfare agents, artificial bone, biofilms, synthetic films, bulk and monolayer deposited catalysts, magnetic resonance imaging contrast agents, eatable goods, consumer safety, crop protection including pesticides and fungicides, cell culture, drugs including vaccines such as those of cancer, homeland and airport security, defense applications, and biomedical and clinical applications such as drugs including those that are illicit. The MAI method using ionizing matrices also comprises rapid or online monitoring of environmental, biological or chemical processes and reactions with minor or no human operational input such as those of automated, untrained, or un-manned operation. The novel ionizing matrices are useful in, e.g., NSF, DOE, FDA, DOD, NASA, and NIH research and applications. The invention will be further illustrated with the following non-limiting examples.

EXAMPLES

Example 1

Instrumentation

MAIV was performed on a Waters SYNAPT G2 (Waters Corporation, Milford, Mass.) from atmospheric and intermediate pressure using commercial Z-Spray and intermediate pressure vacuum MALDI sources, respectively. The atmospheric pressure ESI source housing was removed and interlocks overridden. A commercial Z-Spray source cone was used for matrix-analyte introduction by pipet tip. A modified cone with a widened inlet of ca. 3 mm was used for matrix-analyte introduction by a glass microscopy slide. The atmospheric pressure source was operated with the source block temperature varied from 30 to 150° C. The intermediate pressure vacuum source (~0.16 Torr) was operated at ambient temperature with ion extraction near 0 V and the laser turned off, i.e., laserspray ionization vacuum settings. Matrix-analyte samples were spotted onto stainless steel MALDI target plates before inserting into the intermediate pressure source of the SYNAPT G2 mass spectrometer. The mass spectral and drift time data from the SYNAPT G2 were analyzed by MassLynxv4.1 and DriftScope v2 and resolution values were obtained from ResCalc v.2.2.3. Microscopy images of recrystallized matrix compounds were taken with a Nikon Eclipse LV 100 optical microscope. Other mass spectrometers and analytical instrumentation used include Fourier transform (FT) from Bruker (FT-ion cyclotron resonance), Thermo (Orbitraps including Fusion, XL, Exactive), ion traps from Thermo (LTQ Velos and XL), single quadrupoles (QDa from Waters and Expression from Advion), multiple quadrupoles (Xevo TQ-S from Waters, Triple TOF 5600 from Sciex), QTOF's (SYNAPT G2-S from Waters), Agilent 6560 Ion Mobility Q-TOF, MALDI-TOF/TOF Ultraflextreme, and Advion Nanomate.

Example 2

Testing Ionizing Matrices

Figure 2A:
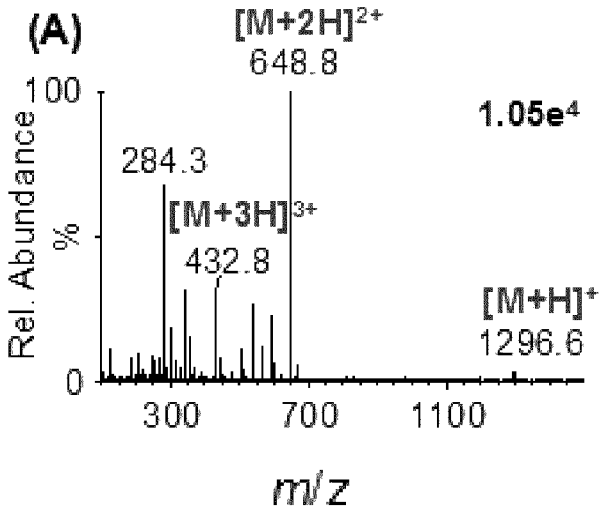
FIGS. 2A-2D show mass spectra of angiotensin (FIGS. 2A-2C) and a mixture of bradykinin and clozapine (FIG. 2D) obtained using four representative ionizing matrices that are liquids at room temperature or have low melting points close to room temperature.
Figure 2B:
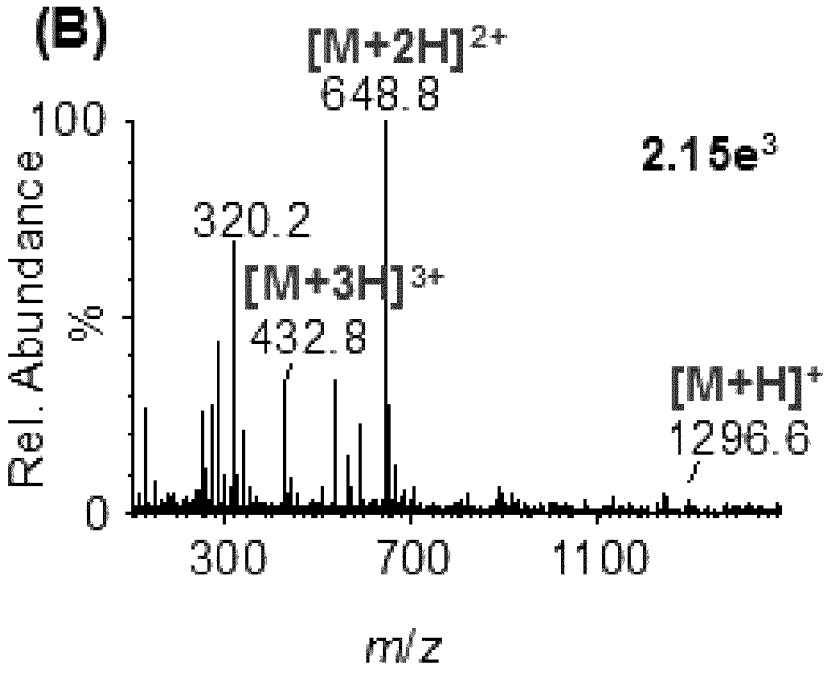
Figure 2C:
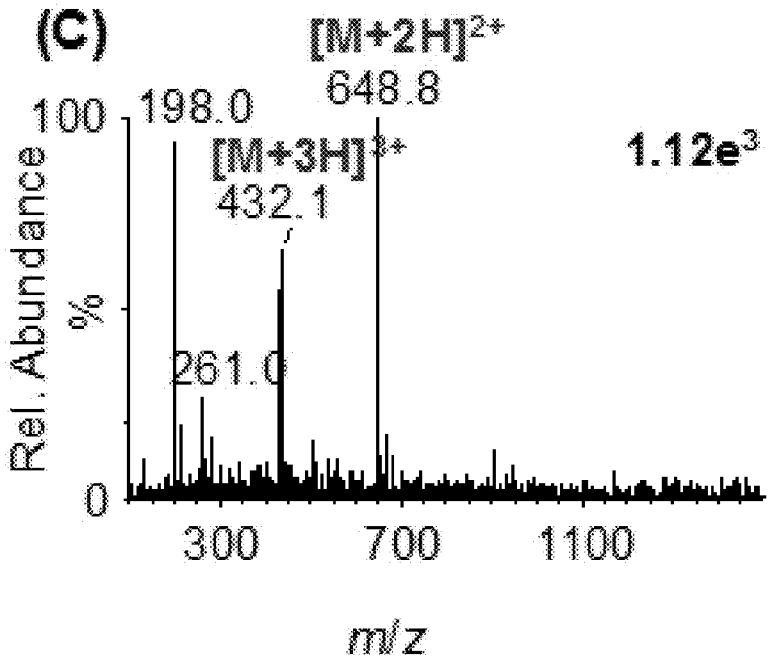

We analyzed the ionization properties of three of the representative room temperature liquid matrix compounds ((1) 1,3-dimethyl-2-nitrobenzene, (2) 3-methoxybenzonitrile, and (3) methyl-4-methyl-4-nitropentanoate) using the peptide angiotensin I as the analyte (FIGS. 2A-2C). Specifically, one microliter of a solution containing matrix and analyte was drawn into a pipet tip and brought in contact with dry ice to freeze the mixture. Care was taken that the aqueous solution of the analyte was removed prior to freezing the matrix-analyte to obtain the solid state crystal. Dry ice was used as a sample support to introduce the solidified matrix-analyte sample to the Z-Spray inlet aperture operated at 30° C. Care was also taken to avoid melting during sample introduction by having a small gap between the solid matrix-analyte and the inlet aperture. Cracking was observed as the matrix froze splintering off matrix-analyte which entered the inlet.

Figure 2D:
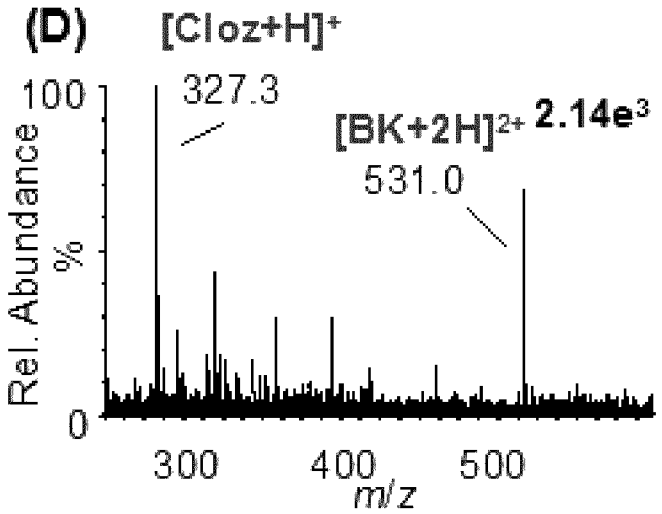

FIGS. 2A-2C show the mass spectra obtained for angiotensin I using the ionizing matrices 1,3-dimethyl-2-nitrobenzene (FIG. 2A), 3-methoxybenzonitrile (FIG. 2B), methyl-4-methyl-4-nitropentanoate (FIG. 2C). FIG. 2D shows the mass spectra of a mixture of bradykinin and clozapine using the ionizing matrix sulfolane (or tetramethylene sulfone, 2,3,4,5-tetrahydrothiophene-1,1-dioxide) in the frozen state with the inlet of the Waters SYNAPT G2 mass spectrometer at 30° C. and providing a region of sub-atmospheric pressure to initiate ionization. Up to three protons were added to the gas-phase angiotensin I molecules by each of the matrices. The three room temperature liquid matrices and the low melting point matrix sulfolane (melting point 20 to 26° C.) ionized with high intensity and produced up to $[M+3H]^{+3}$ (or +3) for angiotensin I and bradykinin (+2) and clozapine (+1) charge state ions.

Figure 3:
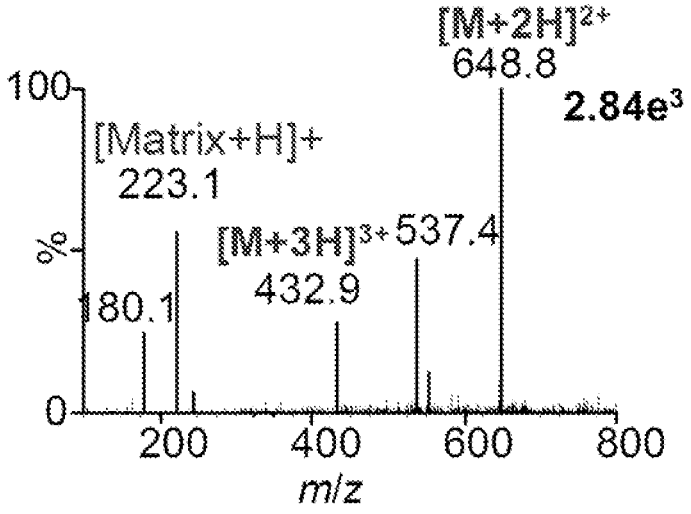
FIG. 3 shows a mass spectrum obtained using a representative ionizing matrix (2,5-diphenyl-1,3,4-oxadiazole) using a solvent-free sample preparation.

The ionizing matrix:analyte sample can also be ground together to form the sample in the absence of a solvent. FIG. 3 is a mass spectrum of the peptide angiotensin I obtained using the ionizing matrix 2,5-diphenyl-1,3,4-oxadiazole by grinding the peptide analyte and the MAI matrix together without solvent (solvent-free) and introducing the powder to the inlet of a Waters Corporation SYNAPT G2 mass spectrometer with the inlet at 80° C. The mass spectrum obtained using this ionizing matrix provided multiply charged ions for angiotensin in high ion abundance.

Figure 4:
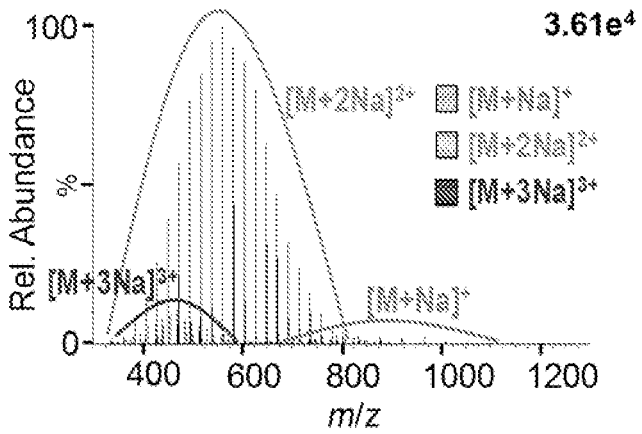
FIG. 4 shows the mass spectrum of a polyethylene glycol (PEG) 1000 oligomer using the representative ionizing matrix phthalonitrile.

Mass spectra with high analyte ion abundance were also obtained by introducing the matrix:analyte sample directly into the intermediate pressure region of a mass spectrometer. FIG. 4 shows the mass spectrum of a low molecular weight polyethylene glycol (PEG) 1000 polymer obtained using the ionizing matrix phthalonitrile where the matrix:analyte sample is directly introduced into the intermediate pressure SYNAPT G2 MALDI source but without the laser. The sample stage and surroundings were at ambient temperature. Using this matrix, primarily doubly charged ions of the oligomers were formed by cation adduction. Protons, mono- or divalent cations can be attached as desired.

Figure 5A:
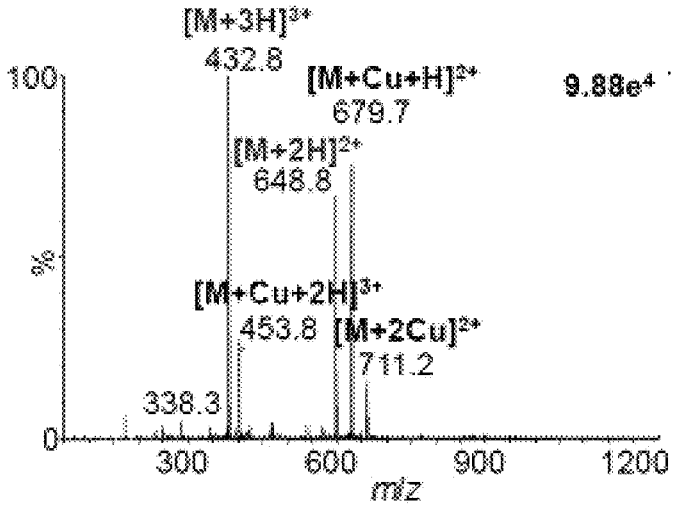
FIGS. 5A-5B show mass spectra obtained using a representative ionizing matrix 5-bromo-3-nitropyridine-2-carbonitrile before (FIG. 5A) and after (FIG. 5B) recrystallization.
Figure 5B:
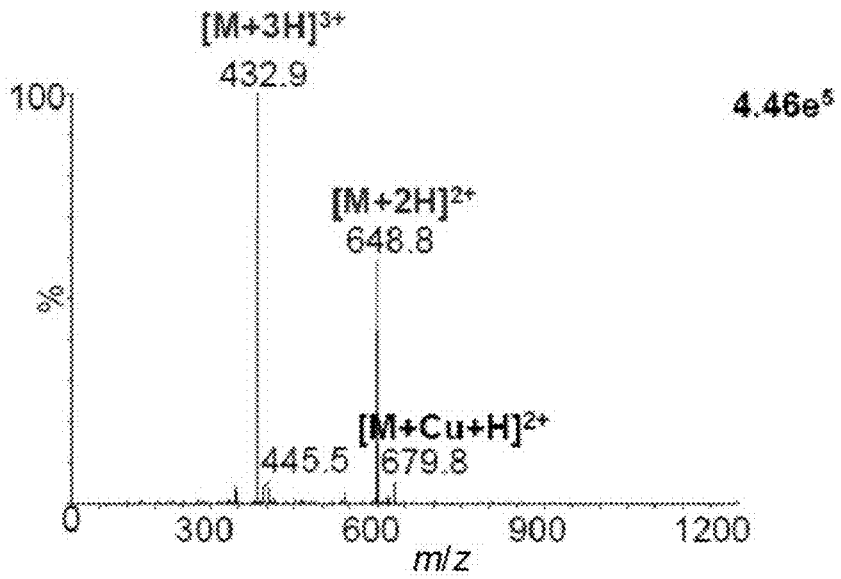

Some ionizing matrices show improved ionization properties after recrystalization. For example, 5-bromo-3-nitropyridine-2-carbonitrile when used as provided by the manufacturer exhibited poor ionizing properties with the peptide analyte angiotensin I, even with the inlet at 100° C. (FIG. 5A). However, excellent quality mass spectra are obtained when the matrix is recrystallized (FIG. 5B), then dissolved with the peptide analyte before drying and introducing the sample into the atmospheric pressure inlet aperture of a Waters SYNAPT G2.

Figure 6A:
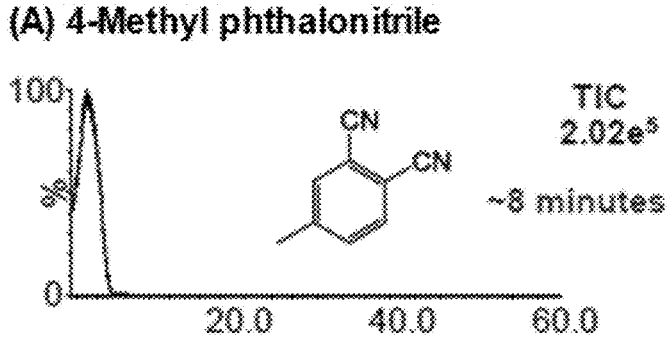
FIGS. 6A-6B show the ion abundance vs. time for representative ionizing matrices (FIG. 6A) 4-methyl phthalonitrile and (FIG. 6B) 2-methyl-2-nitro-1,3-propanediol under vacuum at ambient temperature.
Figure 6B:
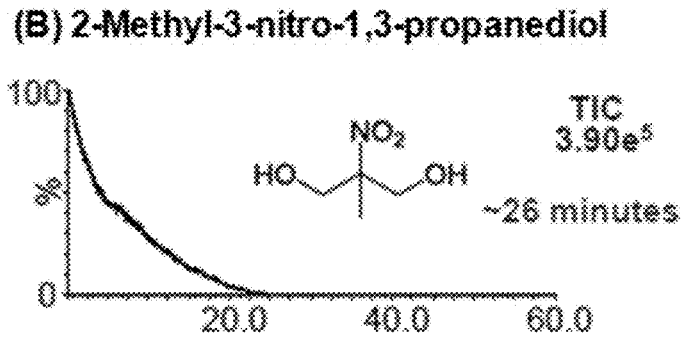

The time over which gas-phase ions are produced with MAI matrices is dependent on the temperature, pressure, and the ionizing matrix. FIGS. 6A-6B the gas-phase ion abundances versus time for the ionizing matrices 4-methyl phthalonitrile (FIG. 6A) and 2-methyl-2-nitro-1,3-propanediol (FIG. 6B) using the vacuum MALDI source of a SYNAPT G2 mass spectrometer at ambient temperature with the laser off. We demonstrated that analyte ion abundances are related to the rate of sublimation of the matrices. Thus, faster subliming matrices produced gas-phase ions over a shorter time period.

Figure 7A:
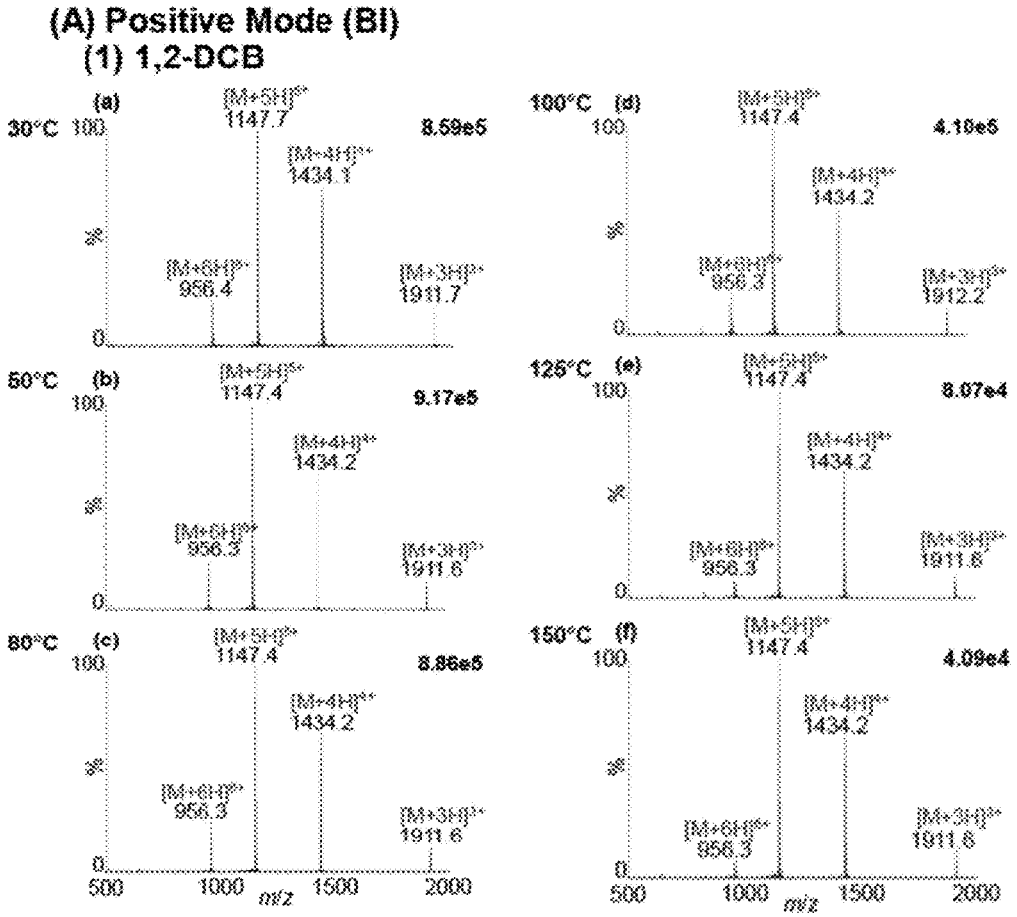
FIGS. 7A-7B show positive ion mass spectra of bovine insulin (FIG. 7A) and negative ion mass spectra of a fragile ganglioside lipid (FIG. 7B) generated using the representative ionizing matrices (1) 1,2-dicyanobenzene, (2) 4-methyl phthalonitrile, and relative to (3) 3-NBN at six different inlet temperatures from 30° C. to 150° C.
Figure 7B:
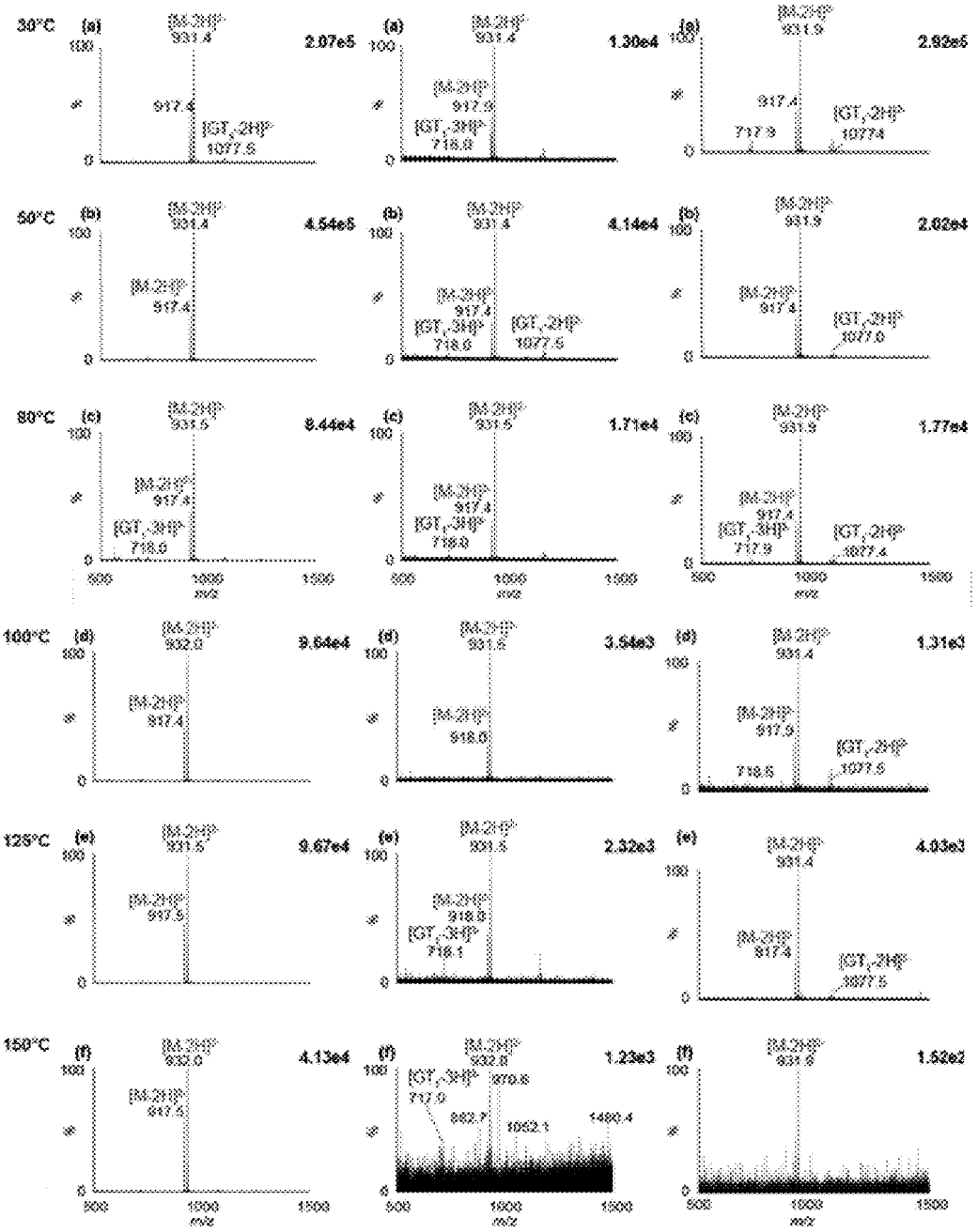

FIGS. 7A and 7B show the effect of temperature on the positive abundance bovine insulin (BI, a small protein, FIG. 7A) and negative ion abundance of fragile gangliosides ($GDl_b$, lipids, FIG. 7B) at various inlet temperatures using the matrices (1) 1,2-dicyanobenzene (1,2-DCB), (2) 4-methyl phthalonitrile and relative to (3) 3-NBN. The results were obtained with the atmospheric pressure inlet to the SYNAPT G2 at inlet temperatures (from top to bottom) 30° C., 50° C., 80° C., 100° C., 125° C., 150° C. The most abundant gas-phase ions were obtained at inlet temperatures of 50° C. and below.

Figure 8A:
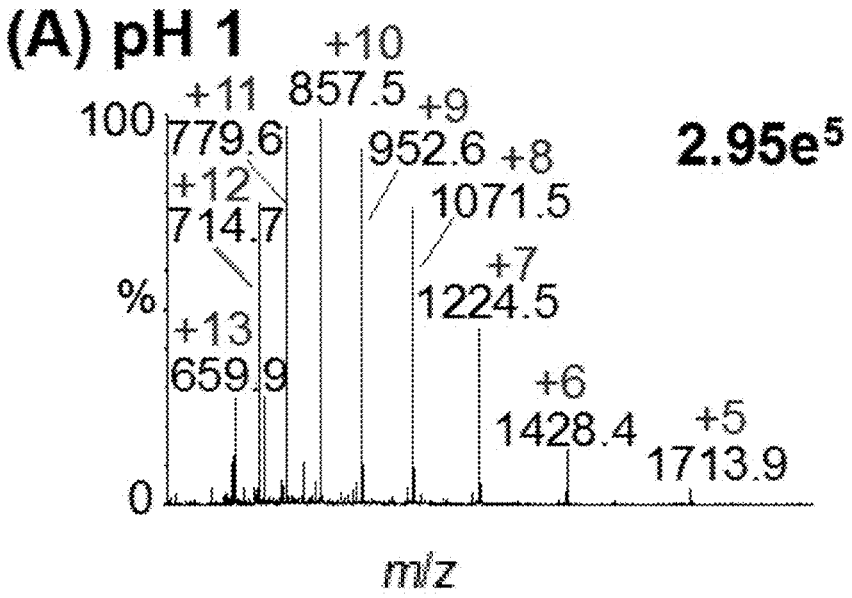
FIGS. 8A-8D show graphs of the relative ion abundance of multiply charged ions of the protein ubiquitin with the representative ionizing matrix 1,2-dicyanobenzene at four different pH values from pH 1 to 9.
Figure 8B:
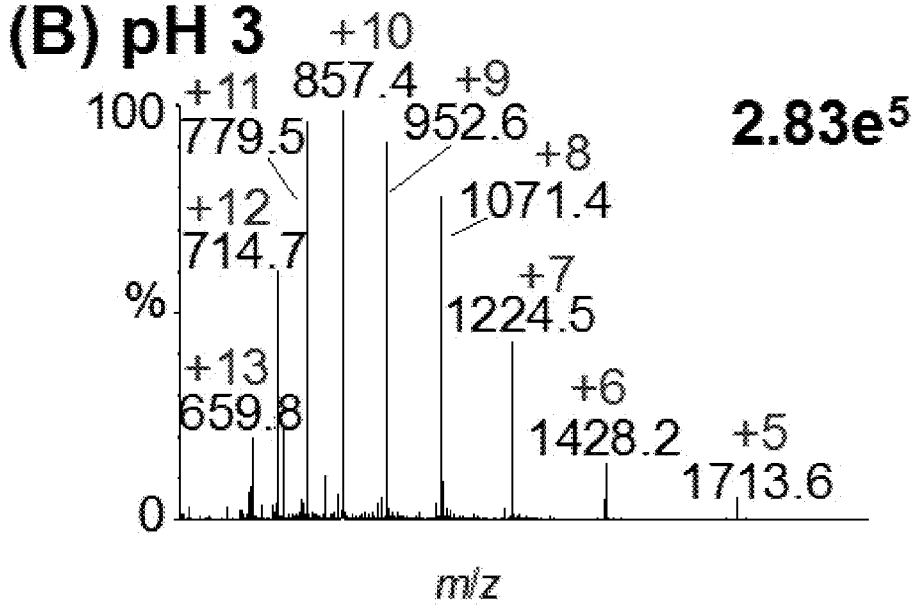
Figure 8C:
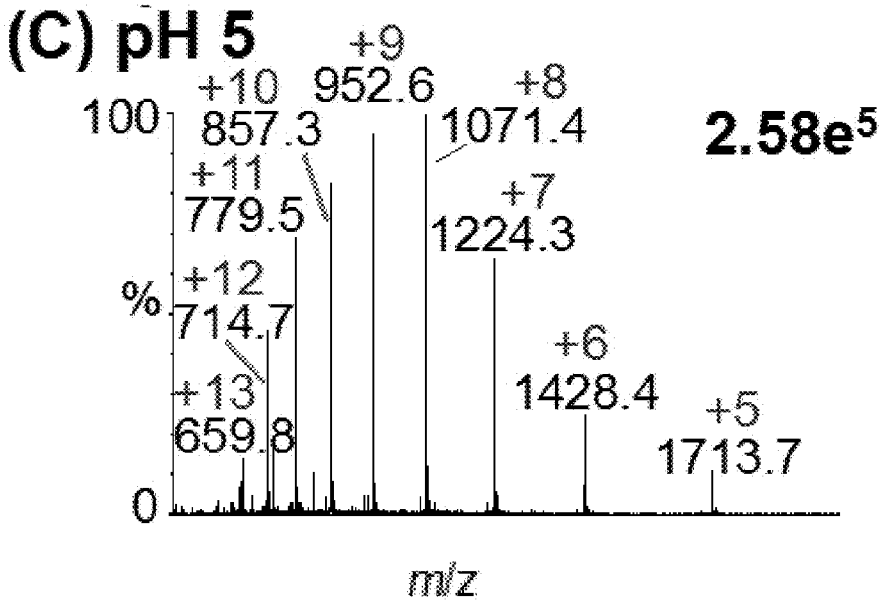
Figure 8D:
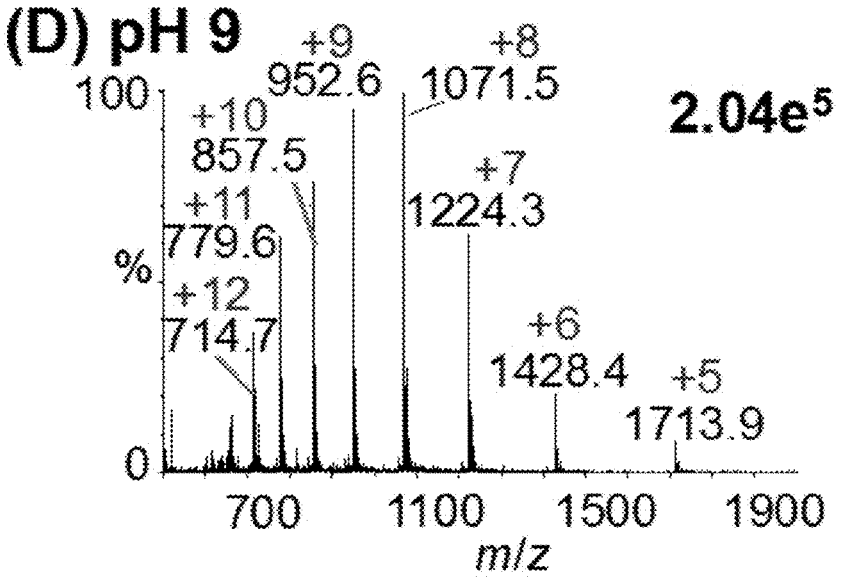

Although temperature and pressure alter the time and abundance of the gas-phase ions, pH has very little effect on the abundance of ions detected. The results shown in FIGS. 8A-8D demonstrate that changes in pH has little effect on the ion abundance of the protein ubiquitin (MW 8560) using the matrix 1,2-DCB with the atmospheric pressure inlet temperature of a Waters SYNAPT G2 at 50° C. The pH range studied, from top to bottom is pH 1 (FIG. 8A), pH 3 (FIG. 8B), pH 5 (FIG. 8C), and pH 9 (FIG. 8D). This matrix is particularly well-suited for both negative mode measurements (e.g., lipids including those that are fragile such as gangliosides (FIG. 7B) are ionized and even from vacuum sources) and positive mode (e.g., carbohydrates, proteins, and synthetic polymers).

Example 3

Additional Applications of Matrix-Analyte Compositions

Figure 9A:
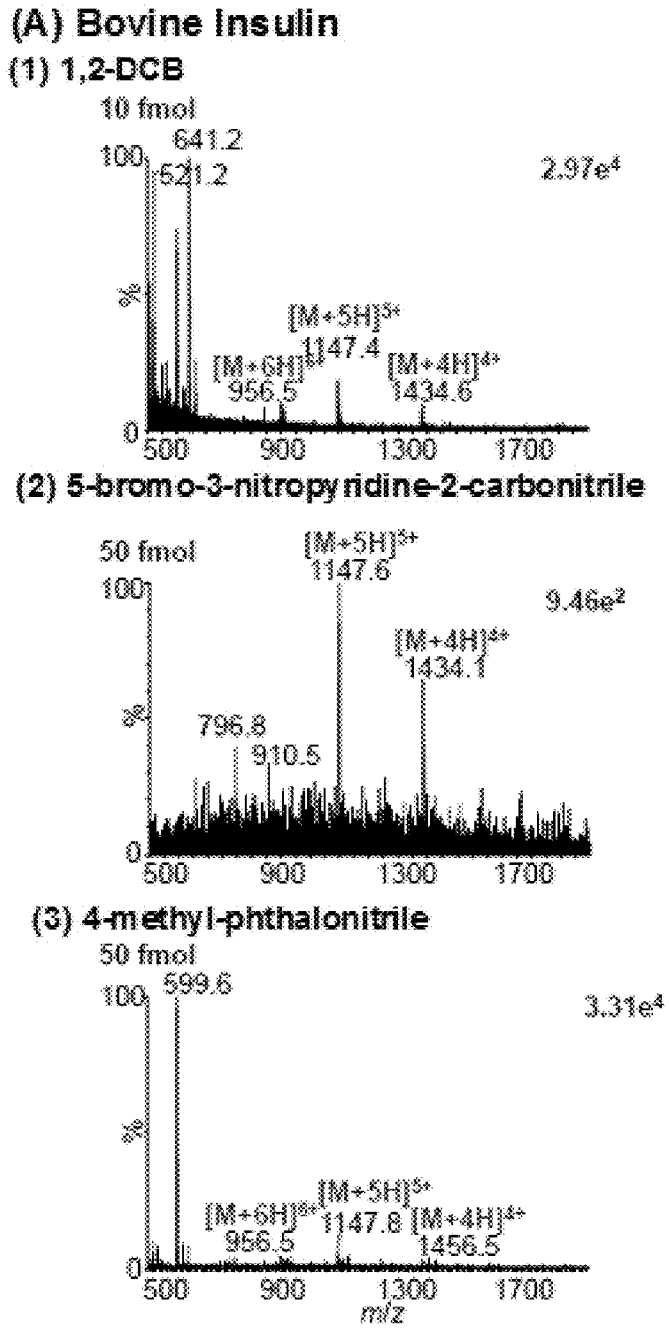
FIGS. 9A-9B show mass spectral data for a sensitivity study using bovine insulin (FIG. 9A) and clozapine (FIG. 9B) using various ionizing matrices (1) phthalonitrile, (2) 4-methyl-phthalonitrile and relative to (3) 3-NBN.
Figure 9B:
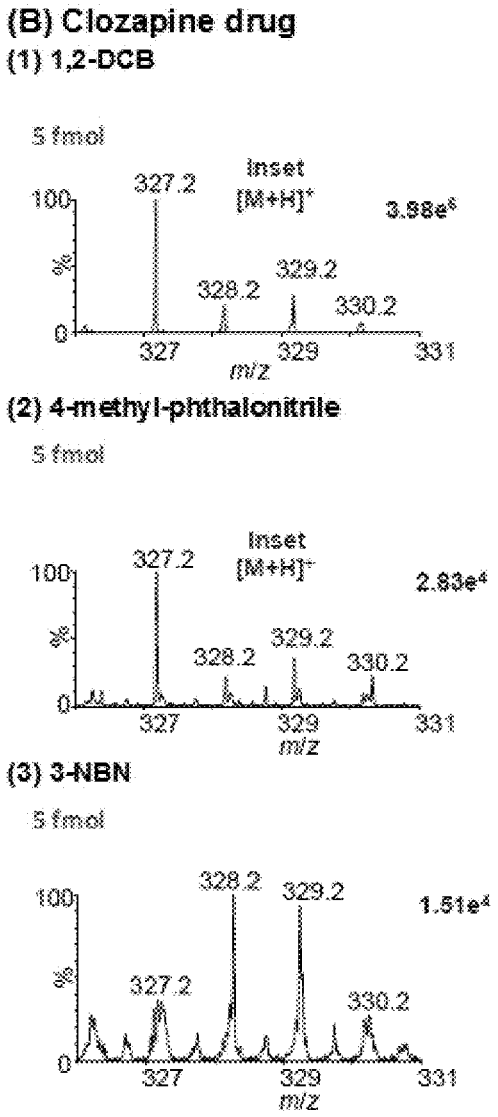
Figure 10A:
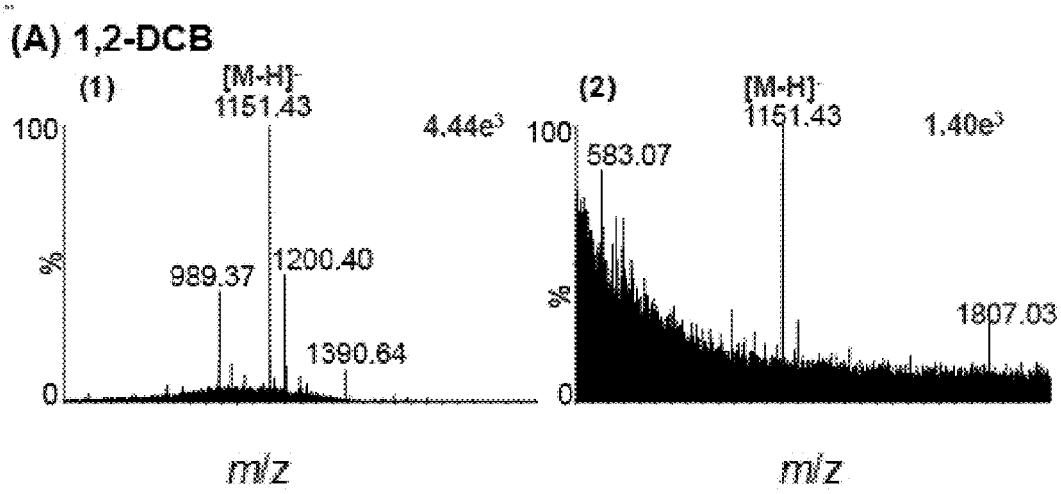
FIGS. 10A-10B show mass spectra of maltoheptaose using ionizing matrix compounds phthalonitrile (1,2-DCB) (FIG. 10A) relative to 3-NBN (FIG. 10B) with (1) and without (2) targeted mass enhancement.
Figure 10B:
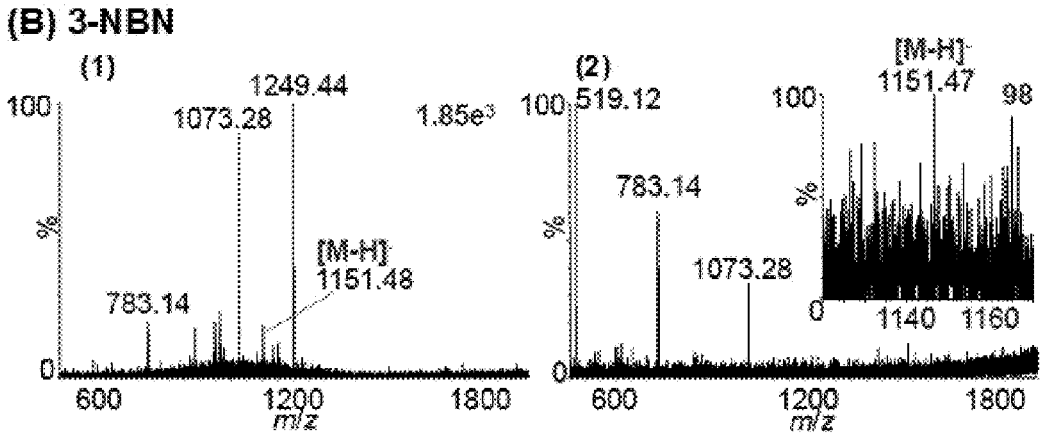
Figure 11A:
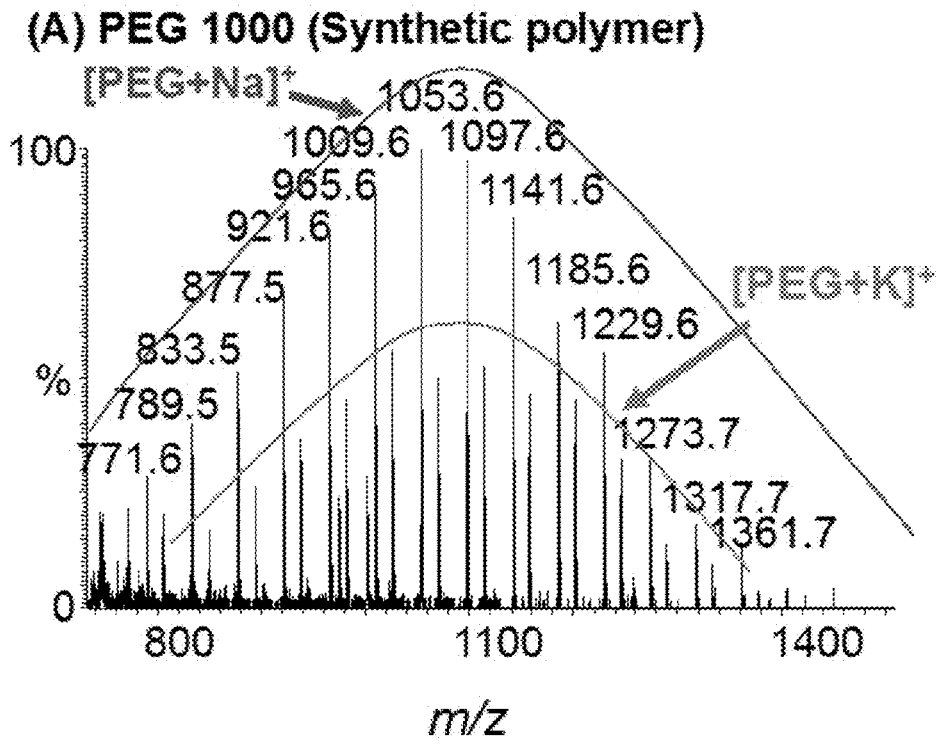
FIGS. 11A-11D show mass spectral analysis of (A) PEG 1000 (synthetic polymer), (B) maltoheptaose (sugar), (C) ubiquitin (protein), (D) phosphoinositol (lipid) using the ionizing matrices (1) 5-bromo-3-nitropicolinonitrile, (2) 4-hydroxy-3-nitro-2H-chromen-2-one, (3) 1 -methyl-4-(methylsulfonyl)-2-nitrobenzene, (4) 5-nitro-1H-indole.
Figure 11B:
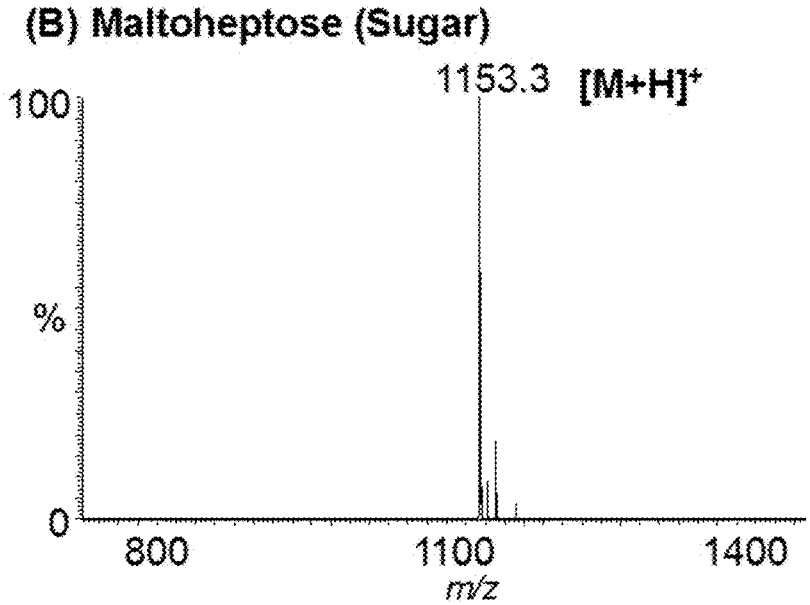
Figure 11C:
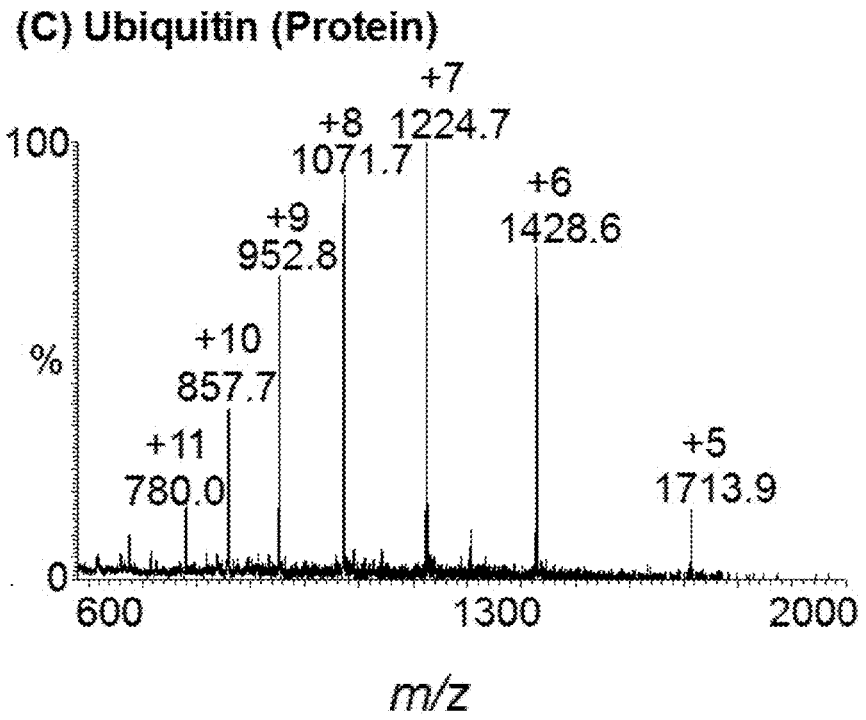
Figure 11D:
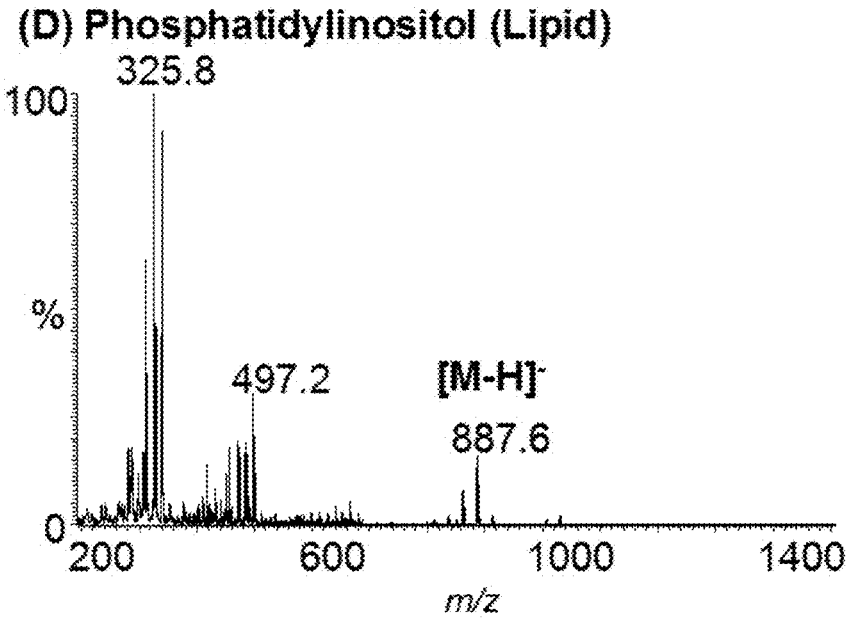

Compounds such as ganglioside lipids have eluded characterization using inlet or vacuum ionization because of insufficient heat on the Waters Z-Spray source and harsh conditions on the intermediate pressure source, respectively. Through fundamental studies, a number of ionizing matrix compounds were found to consistently produce high analyte ion intensity with good spectral quality based on signal-to-noise ratio, chemical background, mass resolution and accuracy (for accurate mass determination) and ion mobility resolution over a larger range of solvents, temperatures, and source conditions for peptides, proteins, ganglioside lipids and polyethylene glycol (PEG). On the atmospheric pressure Z-Spray source, 10 fmol of bovine insulin (FIG. 9A) was detected using the matrices (1) phthalonitrile, (2) 5-bromo-3-nitropyridine-2-carbonitrile, and (3) 4-methyl-phthalonitrile also demonstrated exceptional sensitivity, ionizing 50 fmol of clozapine (FIG. 9B) (m/z 327) using (1) phthalonitrile, (2) 4-methyl-phthalonitrile and relative to (3) 3-NBN on the vacuum source, readily identifying the unique isotopic distribution of this drug compound clozapine as well as its metabolites even from mouse brain tissue. FIGS. 10A-10B shows the mass spectra of 10 pmol of maltoheptaose in 1:1 water:methanol using the new ionizing matrix phthalonitrile FIG. 10A versus the previously disclosed best MAIV matrix 3-NBN FIG. 10B with (1) targeted mass enhancement enabled and (2) targeted mass enhancement not enabled. The ionizing matrix phthalonitrile provides an enhanced mass spectra of this carbohydrate relative to 3-NBN. As additional examples, compounds such as PEG 1000 (synthetic polymer; FIG. 11A), maltoheptaose (sugar, carbohydrate; FIG. 11B), ubiquitin (protein; FIG. 11C), phosphoinositol (lipid; FIG. 11D) are now applicable demonstrating that new types of compound classes can be analyzed and detected in the positive and negative detection mode using ionizing matrices such as the ionizing matrices (A) 5-bromo-3-nitropicolinonitrile, (B) 4-hydroxy-3-nitro-2H-chromen-2-one, (C) 1-methyl-4-(methylsulfonyl)-2-nitrobenzene, (D) 5-nitro-1H-indole. This suggests that the chemical structure of the ionizing matrix is important relative to which compounds are preferentially ionized.

Other embodiments are within the scope of the following claims.

What is claimed is:

1. A method of ionizing an analyte molecule, the method comprising:

providing an ionizing matrix comprising one or more of the compounds 1-(chloromethyl)-4-nitrobenzene, (phenyl sulfonyl)acetonitrile, 3-(methylsulfonyl)benzonitrile, 1-(methylsulfonyl)piperidine-3-carboxylic acid, 2-(methylsulfonyl)acetonitrile, 4-[(2-hydroxyethyl) amino]tetrahydrothiophene-3-ol-1,1-dioxide, 2-(methylsulfonyl)phenol, 4-[(2-hydroxyethyl)namino]tetrahydrothiophene-3-ol 1,1 dioxide, tetrahydrothiophene-3-ol-1,1-dioxide, 3-bromotetrahydrothiophene 1,1-dioxide, (3S,4S)-3-hydroxy-4-(methylamino) tetrahydrothiophene 1,1-dioxide, tetrahydrothiophene 1,1-dioxide, 2-pyridinecarbonitrile, 9-isopropyl-9H-carbazole, 9-vinyl-9H-carbazole, 3,6-dibromo-9H-carbazole, 2,5-diphenyl-1,3,4-oxadiazole, 2,5-dimethylbenzoyl chloride, 2,5-diphenyl-1,3,4-oxadiazole, 3,6-dibroino-9H-carbazole, 2,5-dimethoxybenzoyl chloride, 2,5-dimethylbenzoic acid, 1-(5-bromo-2-hydroxyphenyl)ethan-1 -one, 2-bromo-1-(2-hydroxyphenyl)ethan-1-one, 3-(trifluoromethyl)benzonitrile, 3-methoxybenzonitrile, 4-methyl-1,2-dicyanobenzene, 4-amino-1,2-dicyanobenzene, 1,2-dicyanobenzene, 3-nitrobenzoic acid, 3-nitro-1,2-dicyanobenzene, 3-nitroaniline, 1-(2-nitrophenyl)ethan-1-one, 1-methyl-4-(methylsulfonyl)-2-nitrobenzene, nitrocyclohexane, 5-bromo-5-nitro-1,3-dioxane, 2-bromo-2-nitropropane, methyl-4-methyl-4-nitropentanoate, 2-methyl-2-nitropropan-1,3-diol, 5-nitro-1H-indole, 4-hydroxy-3-nitro-2H-chromen-2-one, 1,3,5-trifluoro-2-nitrobenzene, 1,3-dimethyl-2-nitrobenzene, 4-nitro-1,2-bis(trifluoromethyl)benzene, 5-methoxy-2-nitro aniline, 4-chloro-1-nitro -2-(trifluoromethyl)benzene, 2,4-dinitrophenol, 1-methoxy-2-nitrobenzene, 1-nitro-2-(pentyloxy)benzene, 5-bromo-3-nitropicolinonitrile, 1-nitro -3-vinylbenzene, 4-methyl-3-nitroaniline, 1-(2-hydroxyl-5-methyl-3-nitrophenyl)ethan-1-one, 2-bromo-1-(3-nitrophenyl)ethan-1-one, 3-nitrobenzoyl chloride, (3-nitrophenyl)methanol, 1-(4-hydroxy1-3-nitrophenyl)ethan-1-one, 1-(2-hydroxyl-5-nitrophenyl)ethan-1-one, 3,5-dinitrobenzoyl chloride, 1,3-dinitrobenzene, and 4-chloro-3-nitrobenzonitrile, or a derivative of these compounds;

contacting the ionizing matrix with an analyte to form a sample comprising an analyte and an ionizing matrix; and subliming or evaporating the ionizing matrix in the sample to produce gas-phase positive or negative ions of the analyte.

2. The method of claim 1, wherein the subliming or evaporating step is performed at sub-atmospheric pressure.

3. The method of claim 2, wherein the sub-atmospheric pressure is between 755 mm Hg and $1\times10^{-7}$ mm Hg.

4. The method of claim 1, wherein the gas phase positive or negative analyte ions are singly charged.

5. The method of claim 1, wherein the gas phase positive or negative analyte ions are multiply charged.

6. The method of claim 1, wherein the gas phase positive or negative ions of the analyte are spontaneously produced.

7. The method of claim 1, wherein the ionizing matrix sublimes or evaporates at sub-atmospheric pressure.

8. The method of claim 1, wherein the rate at which the ionizing matrix sublimes or evaporates is temperature dependent.

9. The method of claim 1, wherein abundance and presence of the gas-phase positive and negative ions of the analyte is dependent on the rate of ionizing matrix sublimation or evaporation.

10. The method of claim 1, wherein the subliming or evaporating step is performed by exposing the sample to a stream of gas.

11. The method of claim 1, wherein the sample is placed on a substrate.

12. A method for producing gas-phase analyte ions for analysis by mass spectrometry or ion mobility spectrometry, the method comprising:

mixing an ionizing matrix comprising one or more of the compounds 1-(chloromethyl)-4-nitrobenzene, (phenylsulfonyl)acetonitrile, 3-(methylsulfonyl)benzonitrile, 1-(methylsulfonyl)piperidine-3-carboxylic acid, 2-(methylsulfonyl)acetonitrile, 4-[(2-hydroxyethyl) amino]tetrahydrothiophene-3-ol-1,1-dioxide, 2-(methylsulfonyl)phenol, 4-[-(2-hydroxyethyl)amino]tetrahydrothiophene-3-ol 1,1 dioxide, tetrahydrothiophene-3-of-1,1-dioxide, 3-bromotetrahydrothiophene 1,1-dioxide, (3S,4S)-3-hydroxy-4-(methylamino) tetrahydrothiophene 1,1-dioxide, tetrahydrothiophene 1,1-dioxide, 2-pyridinecarbonitrile, 9-isopropyl-9H-carbazole, 9-vinyl-9H-carbazole, 3,6-dibromo-9H-carbazole, 2,5-diphenyl-1,3,4-oxadiazole, 2,5-dimethylbenzoyl chloride, 2,5-diphenyl-1,3,4-oxadiazole, 3,6-dibromo-9H-carbazole, 2,5-dimethoxybenzoyl chloride, 2,5-dimethylbenzoic acid, 1-(5-bromo-2-hydroxyphenyl)ethan-1-one, 2-bromo-1-(2-hydroxyphenyl)ethan-1-one, 3-(trifluoromethyl)benzonitrile, 3-methoxybenzonitrile, 4-methyl-1,2-dicyanobenzene, 4-amino-1,2-dicyanobenzene, 1,2-dicyanobenzene, 3-nitrobenzoic acid, 3-nitro-1,2-dicyanobenzene, 3-nitroaniline, 1-(2-nitrophenyl)ethan-1-one, 1-methyl-4-(methylsulfonyl)-2-nitrobenzene, nitrocyclohexane, 5-bromo-5-nitro-1,3-dioxane, 2-bromo-2-nitropropane, methyl-4-methyl-4-nitropentanoate, 2-methyl-2-nitropropan-1,3-diol, 5-nitro-1H-indole, 4-hydroxy-3-nitro-2H-chromen-2-one, 1,3,5-trifluoro-2-nitrobenzene, 1,3-dimethyl-2-nitrobenzene, 4-nitro-1,2-bis(trifluoromethyl)benzene, 5-methoxy-2-nitroaniline, 4-chloro-1-nitro-2-(trifluoromethyl)benzene, 2,4-dinitrophenol, 1-methoxy-2-nitrobenzene, 1-nitro-2-(pentyloxy)benzene, 5-bromo-3-nitropicolinonitrile, 1-nitro-3-vinylbenzene, 4-methyl-3-nitroaniline, 1-2-hydroxyl-5-methyl-3-nitrophenyl)ethan-1-one, 2-bromo-1-(3-nitrophenyl)ethan-1-one, 3-nitrobenzoyl chloride, (3-nitrophenyl)methanol, 1-(4-hydroxyl-3-nitrophenyl) ethan-1-one, 1-(2-hydroxyl-5-nitrophenypl)ethan-1-one, 3,5-dinitrobenzoyl chloride, 1,3-dinitrobenzene, and 4-chloro-3-nitrobenzonitrile, and an analyte to produce a matrix:analyte sample; and exposing the matrix:analyte sample to sub-atmospheric pressure to initiate charge separation and production of analyte ions from the matrix:analyte sample.

13. The method of claim 12, wherein the mixing is performed by dissolving the ionizing matrix and analyte in a solvent.

14. The method of claim 13, wherein the solvent is water, methanol, ethanol, isopropanol, propanol, butanol, isobutanol, acetonitrile, tetrahydrofuran, chloroform, dimethylformamide, dimethyl sulfoxide, acetone, ethyl acetate, dioxane, dimethylformamide, methylpyrrolidone, pyridine, hexane, petroleum ether, or a mixture thereof.

15. The method of claim 12, wherein the mixing is performed by grinding the matrix and analyte together to form a powder.

16. The method of claim 12, wherein the matrix:analyte sample is placed on a substrate.

17. The method of claim 12, wherein the matrix:analyte sample is a solution when exposed to sub-atmospheric pressure.

18. The method of claim 12, whereby the matrix:analyte sample is a solid when exposed to sub-atmospheric pressure.

19. A composition comprising an ionizing matrix compound from the compounds 1-(chloromethyl)-4-nitrobenzene, (phenyl sulfonyl)acetonitrile, 3-(methylsulfonyl)benzonitrile, 1-(methylsulfonyl)piperidine-3-carboxylic acid, 2-(methylsulfonyl)acetonitrile, 4-[(2-hydroxyethypamino] tetrahydrothiophene-3-ol-1,1-dioxide, 2-(methylsulfonyl) phenol, 4-[(2-hydroxyethyl)amino]tetrahydrothiophene-3-ol 1,1 dioxide, tetrahydrothiophene-3-ol -1,1-dioxide, 3-bromotetrahydrothiophene 1,1-dioxide, (3S,4S)-3-hydroxy-4-(methylamino)tetrahydrothiophene 1,1-dioxide, tetrahydrothiophene 1,1-dioxide, 2-pyridinecarbonitrile, 9-isopropyl-9H-carbazole, 9-vinyl-9H-carbazole, 3,6-dibromo-9H-carbazole, 2,5-diphenyl-1,3,4-oxadiazole, 2,5-dimethylbenzoyl chloride, 2,5-diphenyl-1,3,4-oxadiazole, 3,6-dibromo-9H-carbazole, 2,5-dimethoxybenzoyl chloride, 2,5-dimethylbenzoic acid, 1-(5-bromo-2-hydroxyphenyl) ethan-1-one, 2-bromo-1-(2-hydroxyphenynethan-1-one, 3-(trifluoromethyl)benzonitrile, 3-methoxybenzonitrile, 4-methyl-1,2-dicyanobenzene, 4-amino-1,2-dicyanobenzene, 1,2-dicyanobenzene, 3-nitrobenzoic acid, 3-nitro-1,2-dicyanobenzene, 3-nitroaniline, 1-(2-nitrophenyl)ethan-1-one, 1-methyl-4-(methylsulfonyl)-2-nitrobenzene, nitrocyclohexane, 5-bromo-5-nitro-1,3-dioxane, 2-bromo-2-nitropropane, methyl-4-methyl-4-nitropentanoate, 2-methyl-2-nitropropan-1,3-diol, 5-nitro-1H-indole, 4-hydroxy-3-nitro-2H-chromen-2-one, 1,3,5-trifluoro-2-nitrobenzene, 1,3-dimethyl-2-nitrobenzene, 4-nitro-1,2-bis (trifluoromethyl)benzene, 5-methoxy-2-nitroaniline, 4-chloro-1-nitro-2-(trifluoromethyl)benzene, 2,4-dinitrophenol, 1-methoxy-2-nitrobenzene, 1-nitro-2-(pentyloxy) benzene, 5-bromo-3-nitropicolinonitrile, 1-nitro-3-vinylbenzene, 4-methyl-3-nitroaniline, 1-(2-hydroxy1-5-methyl-3-nitrophenyl)ethan-1-one, 2-bromo-1-(3-nitrophenyl) ethan-1-one, 3-nitrobenzoyl chloride, (3-nitrophenyl) methanol, 1-(4-hydroxyl-3-nitrophenyl)ethan-1-one, 1-(2-hydroxyl-5-nitrophenyl)ethan-1-one, 3,5-dinitrobenzoyl chloride, 1,3-dinitrobenzene, and 4-chloro-3-nitrobenzonitrile, and an analyte.

20. The composition of claim 19 wherein the molar ratio of matrix compound and analyte is of 50:1 to $1\times10^7$:1.

* * * * *